US005997691A

United States Patent [19]

Gautam et al.

[11] Patent Number: 5,997,691

[45] Date of Patent: Dec. 7, 1999

[54] METHOD AND APPARATUS FOR APPLYING A MATERIAL TO A WEB

[75] Inventors: Navin Gautam; Harry V. Lanzillotti; Tyrone W. Murray, all of Midlothian; D. Anh Phan, Richmond, all of Va.; Jon R. Butt, Sr., Woodstock; H. Edmund Clark, Cumming, both of Ga.; Thomas E. Dougherty, Milltown, N.J.; Thomas L. Fillio, Chamblee, Ga.; Vladimir Hampl, Jr., Rosewell, Ga.; Phillip L. Ursery, Roswell, Ga.; Edwin L. Cutright, Powhatan; Ronald L. Edwards, Richmond, both of Va.

[73] Assignee: Philip Morris Incorporated, New York, N.Y.

[21] Appl. No.: 08/678,529

[22] Filed: Jul. 9, 1996

[51] Int. Cl.[6] ..... D21H 11/00

[52] U.S. Cl. ..... 162/134; 162/139; 118/692; 427/288

[58] Field of Search ..... 222/415; 239/76, 239/101, 562; 118/692, 324, 315, 411, 672; 162/109, 134, 252, 253, 261, 272, 262, 199, 139; 427/288, 286, 285, 424; 101/122, 129

[56] References Cited

U.S. PATENT DOCUMENTS

| | | | |
|---|---|---|---|
| 205,312 | 6/1878 | Steele | 222/415 |
| 746,786 | 12/1903 | Burdick . | |
| 1,214,658 | 2/1917 | Dun Lany . | |
| 1,214,659 | 2/1917 | Dun Lany . | |
| 1,513,969 | 11/1924 | Cumfer et al. . | |
| 1,787,218 | 12/1930 | Trask | 162/134 |
| 2,029,273 | 1/1936 | Montgomery et al. . | |
| 2,112,540 | 3/1938 | McAndrews et al. . | |
| 2,426,043 | 8/1947 | Muggleton . | |
| 2,711,120 | 6/1955 | MacLaurin | 162/134 |
| 2,904,448 | 9/1959 | Sorg . | |

(List continued on next page.)

FOREIGN PATENT DOCUMENTS

| | | |
|---|---|---|
| 570440 | 9/1958 | Belgium . |
| 1549596 | 12/1968 | France . |
| 1956906 | 5/1973 | Germany . |
| 51-15065 | 5/1976 | Japan . |
| 51-19850 | 6/1976 | Japan . |
| 895537 | 1/1982 | U.S.S.R. . |
| 246873 | 1/1925 | United Kingdom . |

*Primary Examiner*—Brenda A. Lamb
*Attorney, Agent, or Firm*—Charles E.B. Glenn; Kevin B. Osborne

[57] ABSTRACT

A method and apparatus of manufacturing a web which is striped with add-on material, comprising: a first arrangement which establishes a sheet of base web from a first slurry and moves the established sheet along a first path; a second arrangement for preparing a second slurry; a moving orifice applicator operative so as to repetitively discharge the second slurry upon the moving sheet of base web, the moving orifice applicator comprising: a chamber box arranged to establish a reservoir of the second slurry across the first path; an endless belt having an orifice, the endless belt received through the chamber box; a drive arrangement operative upon the endless belt to continuously move the orifice along an endless path and repetitively through the chamber box, the orifice when communicated with the reservoir being operative to discharge the second slurry from the reservoir through the orifice; a flow distribution system for introducing the second slurry into the chamber box at spaced-apart feed locations along the chamber box; a flow monitoring system for reading fluid pressure at spaced-apart locations along the chamber box; and a controller arranged to identify which of the feed ports is operatively adjacent a monitored location of highest pressure variation, the controller selectively adjusting output of the flow distribution system at the identified feed location counteractively to the highest pressure variation, the controller adjusting output of a remainder of the feed locations counteractively to the output adjustment at the identified feed location.

48 Claims, 16 Drawing Sheets

U.S. PATENT DOCUMENTS

| | | | |
|---|---|---|---|
| 3,084,661 | 4/1963 | Roberts . | |
| 3,090,351 | 5/1963 | Coyne . | |
| 3,287,207 | 11/1966 | Treat . | |
| 3,436,245 | 4/1969 | Grundman . | |
| 3,536,580 | 10/1970 | Fave . | |
| 3,627,630 | 12/1971 | Gagnon | 162/100 |
| 3,633,536 | 1/1972 | Morrison . | |
| 3,687,274 | 8/1972 | Clark et al. . | |
| 3,705,821 | 12/1972 | Breer et al. . | |
| 3,895,603 | 7/1975 | Barouh et al. . | |
| 3,921,793 | 11/1975 | Hutchinson . | |
| 3,923,151 | 12/1975 | Weber . | |
| 3,961,755 | 6/1976 | Morine et al. . | |
| 4,239,591 | 12/1980 | Blake . | |
| 4,305,169 | 12/1981 | Vidalis . | |
| 4,319,524 | 3/1982 | Dunham et al. . | |
| 4,387,123 | 6/1983 | Wollam et al. . | |
| 4,583,486 | 4/1986 | Miller . | |
| 4,739,775 | 4/1988 | Hampl, Jr. . | |
| 4,800,102 | 1/1989 | Takada . | |
| 4,945,932 | 8/1990 | Mentzel et al. . | |
| 4,968,534 | 11/1990 | Bogardy . | |
| 5,174,435 | 12/1992 | Dorner et al. . | |
| 5,417,228 | 5/1995 | Baldwin et al. | 162/349 |
| 5,534,114 | 7/1996 | Cutright et al. . | |

METHOD AND APPARATUS FOR APPLYING A MATERIAL TO A WEB

FIELD OF INVENTION

The present invention relates to method and apparatus for applying a predetermined pattern of add-on material to a base web, preferably in the form of stripes, and more particularly, to a method and apparatus for producing cigarettes papers having banded regions of additional material.

BACKGROUND AND CIRCUMSTANCES OF INVENTION

Techniques have been developed for printing or coating paper webs with patterns of additional material. These prior techniques have included printing with gravure presses, blade coating, roller coating, silkscreening and stenciling.

U.S. Pat. No. 4,968,534 to Bogardy describes a stenciling apparatus wherein a continuous stencil comes into intimate contact with a paper web during application of an ink or the like. The apparatus includes an arrangement which draws air through the stencil prior to the application of the ink. The mechanical arrangement is such that to change the pattern, the stencil must be changed. Additionally, such apparatus are unworkable at the wet-end of paper-making machines.

In the related, commonly assigned application, U.S. Ser. No. 07/847,375, an embodiment of a moving orifice applicator is disclosed which includes an elongate "cavity block" or chamber and a perforated endless belt whose lower traverse passes along the bottom portion of the chamber. The chamber is positioned obliquely across a web-forming device (such as a Fourdinier wire). In operation, a slurry of additional material is continuously supplied to the chamber as the endless belt is looped through the bottom portion of the chamber such that plural streams of material are generated from beneath the chamber to impinge the web passing beneath the chamber. As a result, bands of additional material are applied repetitively to the web. The orientation, width, thickness and spacing of the bands are all determinable by the relative speed and orientation of the endless belt to the moving web.

Preferably, the pattern of additional material is applied as uniformly as possible so as to render consistent product across the entire span of the web. However, Fourdrinier machines are very wide (approximately 10 to 20 feet or more) and that circumstance creates the need to extend the slurry chamber to extreme lengths. Accordingly, fluid conditions, particularly pressure, at one end of a slurry chamber may differ significantly from those at the other. Significantly, we have discovered that variations in pressure can cause the fluid discharge from the orifices to vary significantly as the orifices move from one end of the chamber to the other.

It is believed that as the belt progresses through the slurry chamber, its motion imparts a pumping action upon the slurry. Unless corrective measures are undertaken, this action tends to increase fluid pressure at the downstream end of the chamber (where the belt exits the chamber). The motion of the belt may also create a region of low pressure where the belt enters the chamber. Additionally, the very end portions of the chamber itself tend to impart flow disturbances. All these circumstances can create undesireable variations in the discharge of slurry along the slurry chamber and manifest imperfections in the paper product being manufactured.

In U.S. Ser. No. 07/847,375, slurry is introduced into the chamber at a plurality of spaced-apart locations along the chamber. However, the slurry may be introduced such that it, too, creates local fluid disturbances which can be problematic to uniformity.

When using the applicator in constructing banded cigarette papers, the add-on material is usually a form of fibrous cellulose. Such material tends to collect at or about edges and corners of the apparatus within the chamber. If the collections are allowed to accumulate, they can partially or totally clog the perforations of the endless belt and create other problems that disrupt proper and efficient operation of the applicator.

We have also come to realize that unless precautions are undertaken, the belt may entrain bits of the slurry and carry them out of the chamber. Because the belt moves so quickly, this extraneous slurry is soon thrown from the belt, especially where the path of the belt changes direction. Such action creates spots and other blemishes on the final product, exacerbates machine cleaning requirements and may accelerate wear and tear in the applicator.

OBJECTS OF THE INVENTION

Accordingly, it is an object of the present invention to provide uniformity in the application of a slurry from a moving orifice applicator.

It is another object of the present invention to provide a capacity to correct non-uniformities in fluid conditions along the chamber of a moving orifice applicator.

Yet another object of the present invention is to alleviate the pumping action of the moving belt upon fluid contained within the chamber of a moving orifice applicator.

Still another object of the present invention is to eliminate spotting of a web as it passes beneath a moving orifice applicator.

Another object to the present invention is to provide removal of any extraneous slurry material that may become entrained upon the endless belt of a moving orifice applicator upon exiting the slurry chamber thereof.

Still another object of the present invention is to provide for the introduction of fluid into the chamber of a moving orifice applicator such that disruption and non-uniformities in fluid conditions are minimized.

Yet another object of the present invention is provision for adjustments in fluid conditions at spaced locations along the chamber in a manner which can dynamically achieve and then maintain a uniform fluid pressure throughout the operative portion of the chamber and throughout the operation of the applicator.

Still another object of the present invention is to minimize the disruptive effect of end portions of the chamber of a moving orifice applicator upon fluid conditions within the chamber.

SUMMARY OF INVENTION

These and other objects are achieved with the present invention whose aspects include a method and apparatus for the production of a web having banded regions of add-on material, more particularly a cigarette paper having stripes of additional cellulosic material added thereto. A preferred method includes the steps of: establishing a first slurry, and preparing a base web by laying the first slurry into a sheet form while moving the base web sheet along a first path. The method further comprises the steps of preparing a second slurry; and repetitively discharging the second slurry so as to establish stripes upon the base web. The last step itself includes the steps of establishing a reservoir of the second slurry across the first path; moving a belt having an orifice along an endless path, which path includes an endless path portion along the reservoir where the orifice is communicated with the reservoir so as to discharge the second slurry from the reservoir through the orifice onto the laid first slurry. The method also includes the step of controlling fluid pressure at spaced locations in the reservoir in direction along the endless path portion so as to achieve consistent discharge of the second slurry.

Other aspects of the present invention include, among others, the step of preparing the second slurry by repetitvely refining a cellulosic pulp until a Freeness value is achieved in the range of approximately −300 to −900 ml °SR while removing heat from the cellulosic pulp during at least a portion of the repetitively refining step; chamber box design features which further minimize pressure variations along the reservoir; and chamber box features which minimize wear and facilitate maintenance and repair.

BRIEF DESCRIPTION OF THE DRAWINGS

The above and other objects and advantages of this invention will be apparent upon consideration of the following detailed description, taken in conjunction with the accompanying drawing, in which like reference characters refer to like parts throughout, and in which.

DETAILED DESCRIPTION OF THE PREFERRED EMBODIMENTS

Figure 1A:
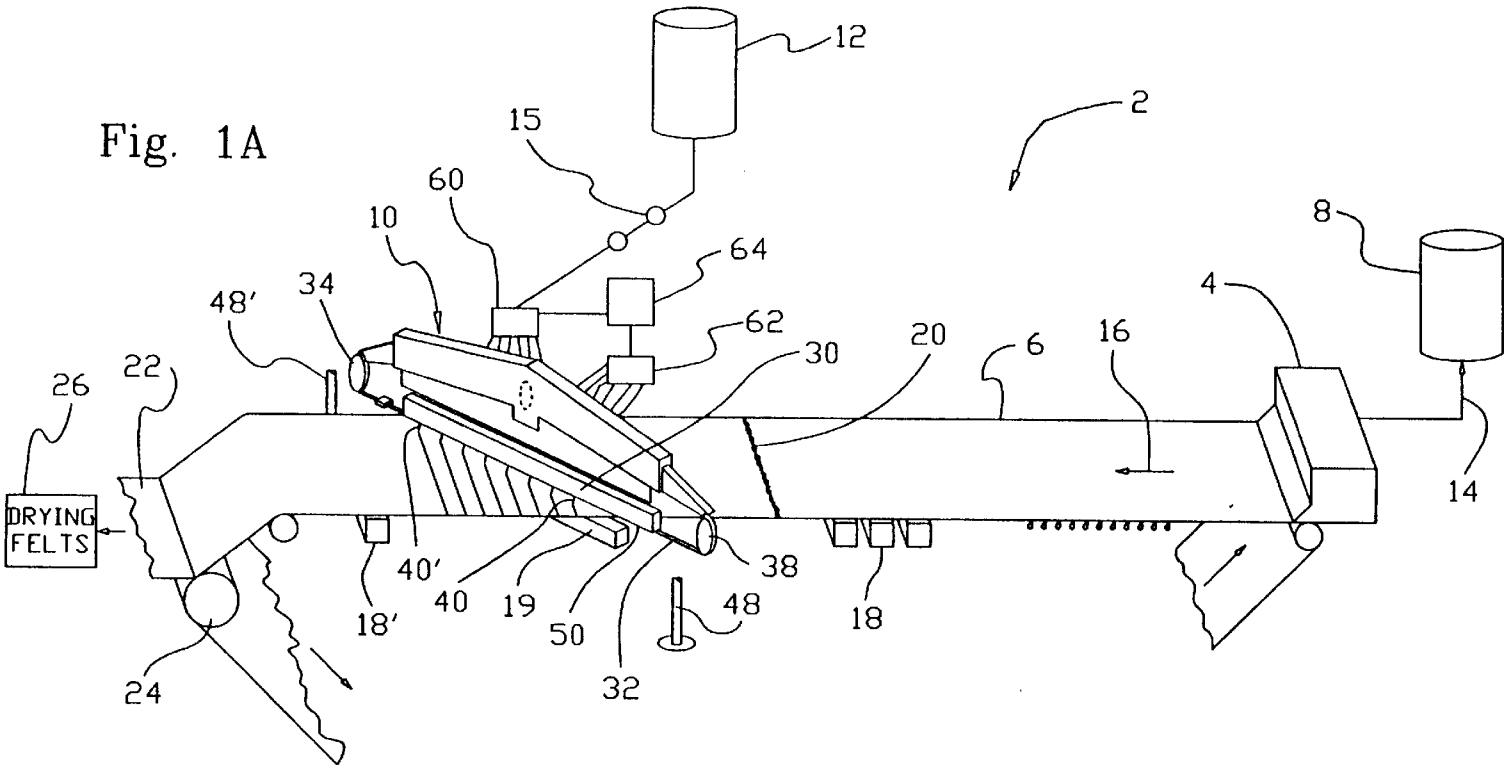
FIG. 1A is a perspective of a paper making machine constructed in accordance with a preferred embodiment of the present invention.

Referring to FIG. 1A, a preferred embodiment of the present invention comprises a cigarette paper making machine 2, which preferably includes a head box 4 operatively located at one end of a Fourdrinier wire 6, a source of feed stock slurry such as a run tank 8 in communication with the head box 4, and a moving orifice applicator 10 in operative communication with another source of slurry such as a day tank 12.

The head box 4 can be one typically utilized in the paper making industry for laying down cellulosic pulp upon the Fourdrinier wire 6. In the usual context, the head box 4 is communicated to the run tank 8 through a plurality of conduits 14. Preferably, the feed stock from the run tank 8 is a refined cellulosic pulp such as a refined flax or wood pulp as is the common practice in the cigarette paper making industry.

The Fourdrinier wire 6 carries the laid slurry pulp from the head box 4 along a path in the general direction of arrow 16 in FIG. 1A, whereupon water is allowed to drain from the pulp through the wire 6 by the influence of gravity and at some locations with the assistance of vacuum boxes 18 at various locations along the Fourdrinier wire 6 as is the establish practice in the art of cigarette paper making. At some point along the Fourdrinier wire 6, sufficient water is removed from the base web pulp to establish what is commonly referred to as a dry line 20 where the texture of the slurry transforms from one of a glossy, watery appearance to a surface appearance more approximating that of the finished base web (but in a wetted condition). At and about the dry line 20, the moisture content of the pulp material is approximately 85 to 90%, which may vary depending upon operating conditions and the like.

Downstream of the dry line 20, the base web 22 separates from the Fourdrinier wire 6 at a couch roll 24. From there, the Fourdrinier wire 6 continues on the return loop of its endless path. Beyond the couch roll 24, the base web 22 continues on through the remainder of the paper making system which further dries and presses the base web 22 and surface conditions it to a desired final moisture content and texture. Such drying apparatus are well known in the art of paper making and may include drying felts 26 and the like.

Figure 2:
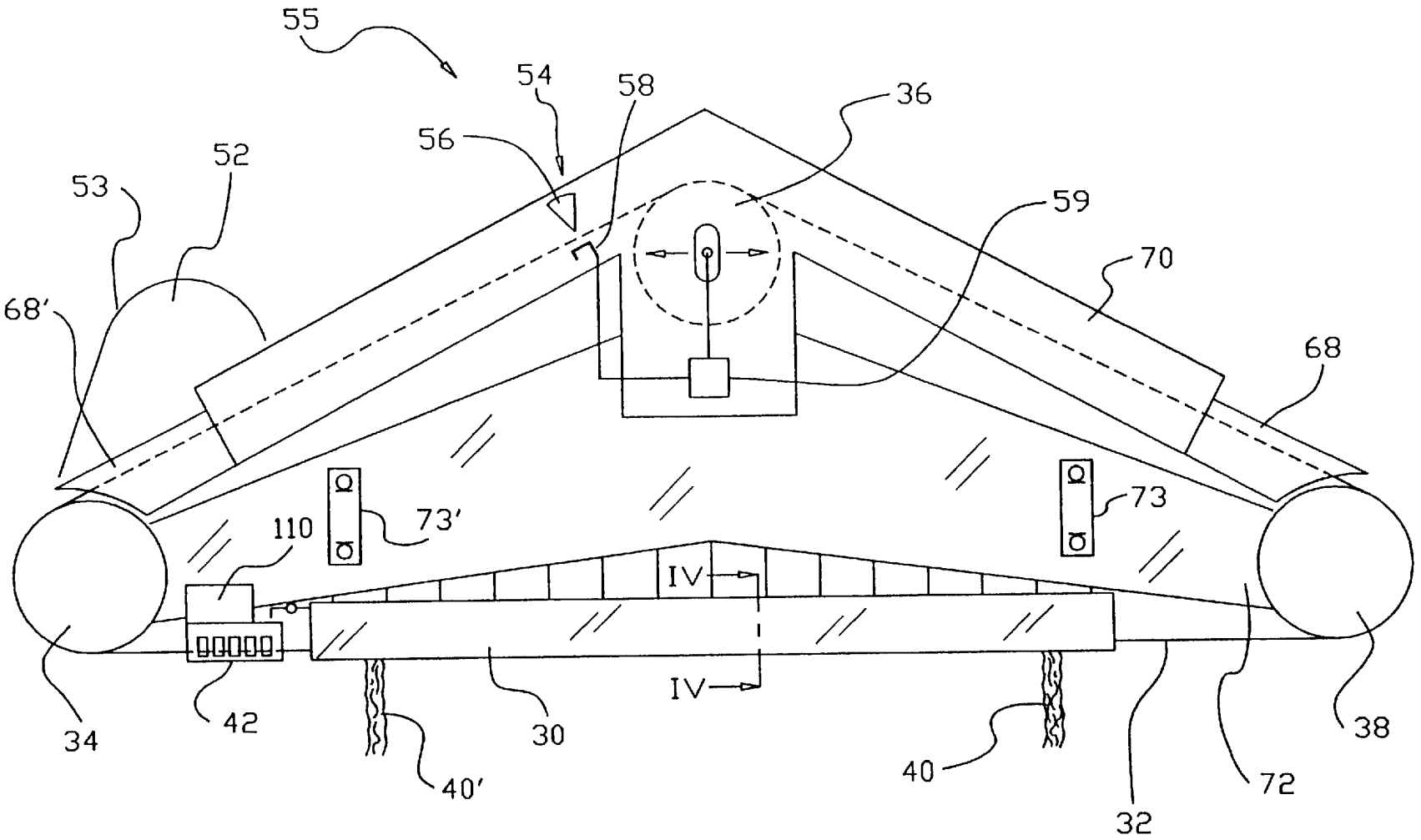
FIG. 2 is a side view of the moving orifice applicator constructed in accordance with a preferred embodiment of the present invention.

Referring now to both FIGS. 1A and 2, the moving orifice applicator 10 preferably comprises an elongate chamber box 30 for establishing a reservoir of add-on slurry in an oblique relation across the path of the Fourdrinier wire 6. The moving orifice applicator also includes an endless perforated steel belt 32, whose pathway is directed about a drive wheel 34, a guide wheel 36 at the apex of the moving orifice applicator 10 and a follower wheel 38 at the opposite end of the chamber box 30 from the drive wheel 34. The endless belt 32 is directed through a bottom portion of the chamber box 30 and subsequently through a cleaning box 42 as it exits the chamber box 30, moves toward the drive wheel 34 and continues along the remainder of its circumlocution.

As each perforation or orifice 44 (FIG. 5) of the belt 32 passes through the bottom portion of the chamber box 30, the orifice 44 is communicated with the reservoir of slurry established in the chamber box 30. At such time, a stream 40 of slurry discharges from the orifice 44 as the orifice 44 traverses the length of the chamber box 30. The discharge stream 40 impinges upon the base 22 passing beneath the moving orifice 10 so as to create a stripe of additional (add-on) material upon the base web 22. The operational speed of the belt 32 may be varied from one layout to another, but in the preferred embodiment, the belt is driven to approximately 1111 feet per minute when the Fourdrinier wire is moving at approximately 500 feet per minute and the chamber box 30 is oriented 27° relative to the direction of the wire. The spacing of the orifices 44 along the belt 32 and the operational speed of the belt 32 is selected such that a plurality of streams 40, 40' emanate from beneath the chamber box 30 during operation of the moving orifice application, simultaneously. Because of the oblique orientation of the moving orifice applicator relative to the path 16 of the base web 22 and the relative speeds of the Fourdrinier wire 6 and the endless belt 32, each stream 40 of add-on material will create a stripe of add-on material upon the base web 22. At the above speeds and angle, the moving orifice applicator 10 will repetitively generate stripes of add-on material that are oriented normal to a longitudinal edge of the base web 22. If desired, the angle and/or relative speeds may be altered to produce stripes which are angled obliquely to the edge of the base web 22.

For a particular orifice 44, after it exits from the chamber box 30, the adjacent portions of the belt 32 about the orifice 44 are cleansed of entrained add-on slurry at the cleaning station 42 and the orifice then proceeds along the circuit of the endless belt 32 to reenter the chamber box 30 to repeat an application of a stripe upon the base web 22.

Referring particularly to FIG. 1A, the moving orifice applicator is preferably situated obliquely across the Fourdrinier wire 6 at a location downstream of the dry line 20 where condition of the base web 22 is such that it can accept the add-on material without the add-on material dispersing itself too thinly throughout the local mass of the base web slurry. At that location, the base web 22 retains sufficient moisture content (approximately 85 to 90%) such that the add-on slurry is allowed to penetrate (or establish hydrogen bonding) to a degree sufficient to bond and integrate the add-material to the base web 22.

Preferably, a vacuum box 19 is located coextensively beneath the chamber box 30 of the moving orifice applicator 10 so as to provide local support for the Fourdrinier wire 6 and facilitate the bonding/integration of the add-on slurry with the base web 20. The vacuum box 19 is constructed in accordance with designs commonly utilized in the paper making industry (such as those of the vacuum boxes 18) The vacuum box 19 is operated at a relatively modest vacuum level, preferably at approximately 60 inches of water or less. Optionally, additional vacuum boxes 18' may be located downstream of the moving orifice applicator 10 to remove the additional quantum of water that the add-on slurry may contribute. It has been found that much of the removal of water from the add-on material occurs at the couch roll 24 where a vacuum is applied of approximately 22–25 inches mercury.

The moving orifice applicator 10 is supported in its position over the Fourdrinier wire 6 preferably by a framework including vertical members 48, 48' which include a stop so that the moving orifice applicator 10 may be lowered consistently to a desired location above the Fourdrinier wire 6, preferably such that the bottom of the chamber box 30 clears the base web 22 on the Fourdrinier wire 6 by approximately one to two inches, preferably less than 1.5 inch.

Preferably, the chamber box 30 is of a length such that the opposite end portions 50, 50' of the chamber box 30 extend beyond the edges of the base web 22. The over-extension of the chamber box 30 assures that any fluid discontinuities existing arising at the end portions of the chamber box 30 do not affect the discharge streams 40 as the streams 40 deposit add-on material across the base web 22. By such arrangement, any errand spray emanating from the ends of the chamber box 30 occurs over edge portions of the base web 22 that are trimmed away at or about the couch roll 24.

Either or both of the vertical members 48, 48' of the support frame work for the moving orifice applicator 10 may be pivotal about the other so as to adjust angulation of the applicator 10 relative to the Fourdrinier wire 6. However, our preferred practice has been to fix the vertical members 48, 48' of the support frame work and to vary only the speed of endless belt 32 in response to changes in operating conditions of the paper making machine 2.

The chamber box 30 receives add-on slurry from the day tank 12 at spaced locations along the chamber box 30. Uniform pressure is maintained along the length of the chamber box 30 by the interaction of a flow distribution system 60, a pressure monitoring system 62 and a programmable logic controller 64 such that the pumping action of the belt 22 and other flow disturbances along the length of the chamber box 30 are compensated locally and continuously to achieve the desired uniformity of pressure throughout the chamber box 30. A main circulation pulp 15 delivers slurry from the day tank 12 to the flow distribution system 60.

Details regarding how the controller initiates and maintains uniform pressure along the chamber box 30 will be discussed later in reference to FIGS. 9–15.

Figure 3A:
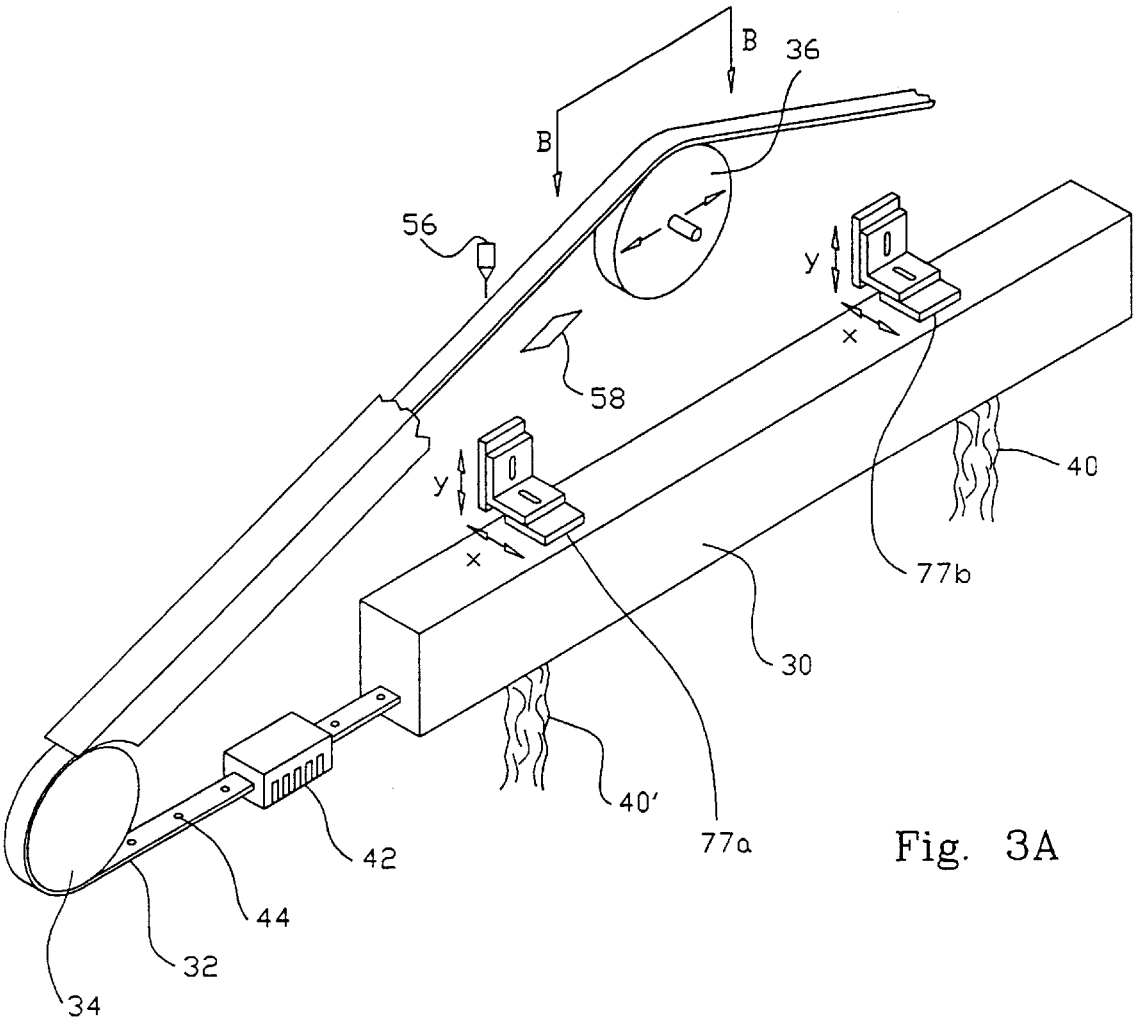
FIG. 3A is a breakaway perspective view of the applicator of FIG. 2.

Referring now to FIGS. 2 and 3A, the drive wheel 34 is driven by a selectable speed motor 52 which is operatively connected to the drive wheel 34 by a drive belt. Preferably, the motor 52 is supported by the framework of the moving orifice applicator, and both the motor 52 and the drive belt are encased within a housing 53 so as to capture any extraneous material (such as bits of slurry) that may find its way to and be otherwise flung from the drive system of the drive wheel 34. Preferably, the motor is an Allen-Bradley Model 1329C-B007NV1850-B3-C2-E2, 7.5 hp., with a Dynapa Tach 91 Modular Encoder. Of course, other types and models of motors that are known to those of ordinary skill in the pertinent art would be suitable for this application.

The drive wheel 34 is advantageously positioned upstream of the chamber box 30 along the pathway of the belt 32 so that the belt 32 is pulled through the chamber box 30. A significant degree of the directional stability is achieved by the close fit of the belt 32 throughout the length of the elongate chamber box 30. However, precise control of the tracking of the belt 32 about its pathway circuit is effected by placement of an infrared proximity sensor 54 at a location adjacent the guide wheel 36. The infrared proximity sensor 54 comprises an emitter 56 and a sensor 58 which are mutually aligned relative to one of the edges of the belt 32 such that if the belt strays laterally from its intended course, a signal from the sensor is affected by a relative increase or decrease in the interference of the edge with the emitter beam. A controller 59 in communication with the sensor 58 interprets the changes in the signal from the sensor 58 to adjust the yaw of the guide wheel 36 about a vertical axis so as to return the edge of the belt 32 to its proper, predetermined position relative to the beam of the emitter 56.

Suitable devices for the proximity sensor 54 includes a Model SE-11 Sensor which is obtainable from the Fife Corporation of Oklahoma City, Okla.

Figure 3B:
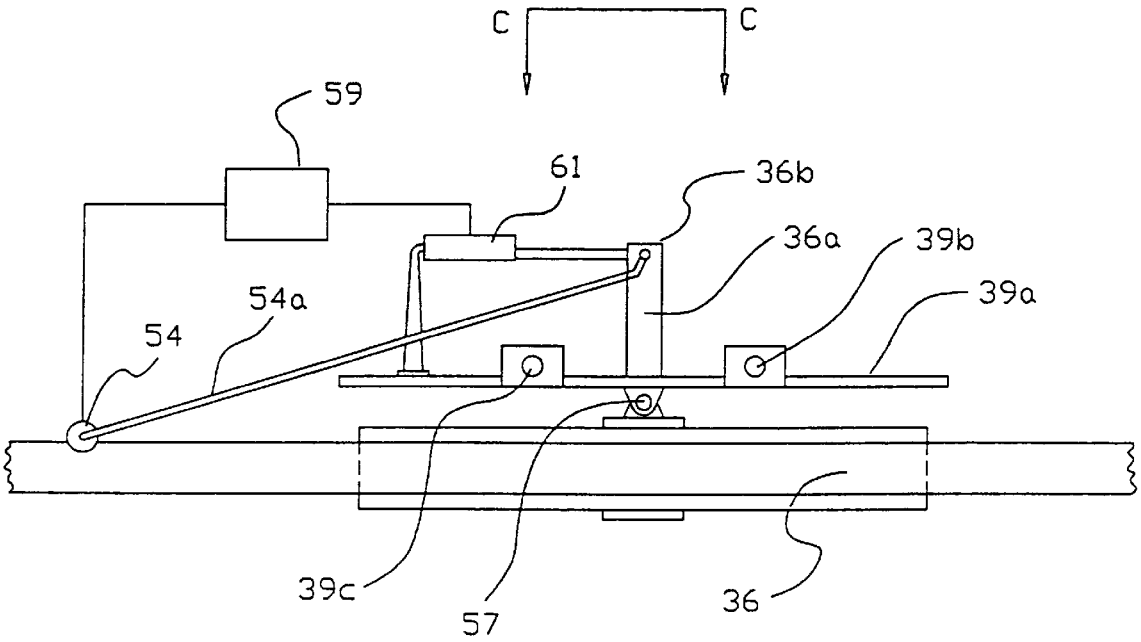
FIG. 3B is a top planar view of tracking control system of the applicator as viewed in the direction of the double pointed arrow B—B in FIG. 3A.

Referring now also to FIG. 3B, the guide wheel 36 rotates about a horizontally disposed axle 36*a*, which itself is pivotal about a vertical axis at a pivotal connection 57 by the controlled actuation of a pneumatic actuator 61 The actuator 61 is operatively connected to a free end portion 36*b* of the axle 36*a* and is responsive to signals received from the controler 59. Preferably, both the pivotal connection 57 and the actuator 61 are fixed relative to the general framework of the applicator 10 during operation the applicator 10; and a connection 54*a* is provided between the sensor 54 and the free end 36*b* of the axle 36*a* so that the sensor 54 rotates as the yaw of the guide wheel 36 is adjusted. The connection 54a assures that the sensor 54 remains proximate to the edge of the belt 32 as the guide wheel 36 undergoes adjustments.

Preferably, the actuator 61 and the pivotal connection 57 are affixed upon a plate 39*a* which is vertical displaceable along fixed vertical guides 39*b* and 39*c*. Preferably, releaseable, vertical bias is applied to the plate 39*a* so as to urge the guide wheel 36 into its operative position and to impart tension in the endless belt 32.

Along the return path of the endless belt 32, from the drive wheel 34 over the guide wheel 36 and back to the follower wheel 38, the belt 32 is enclosed by a plurality of housings, including outer housings 68, 68' and a central housing 70 which also encloses the infrared proximity sensor 54 and the controller 59 of the tracking system 55. The housing 68, 68' and the housing 70 prevent the flash of errand slurry upon the base web 22 as the belt 32 traverses the return portion of its circuit.

Referring particularly to FIG. 2, the housings 70 and various other components of the applicator 10 (such as the wheels 34, 36 and 38; the chamber box 30; the cleaning box 42; and the motor 52) are supported by and/or from a planar frame member 72. The planar frame member 72 itself is attached at hold-points 73,73' to a cross-member (an I-beam, box beam or the like), which cross-member is supported upon the vertical members 48, 48'. In the alternative, an I-beam member or a box beam member may be used as a substitute for the frame member 72, with the chamber box 30 and other devices being supported from the beam member.

Referring again to FIG. 3A, in either support arrangement, the chamber box 30 is preferably hung from the support member with two or more, spaced apart adjustable mounts 77*a*, 77*b* that permit vertical and lateral adjustment (along arrows y and x in FIG. 3A, respectively) of each end of the chamber box 30 so that the chamber box 30 may be accurately leveled and accurately angled relative to the Foundrinier wire, and so that the chamber box 30 may be accurately aligned with the belt 32 to minimize rubbing.

Figure 4:
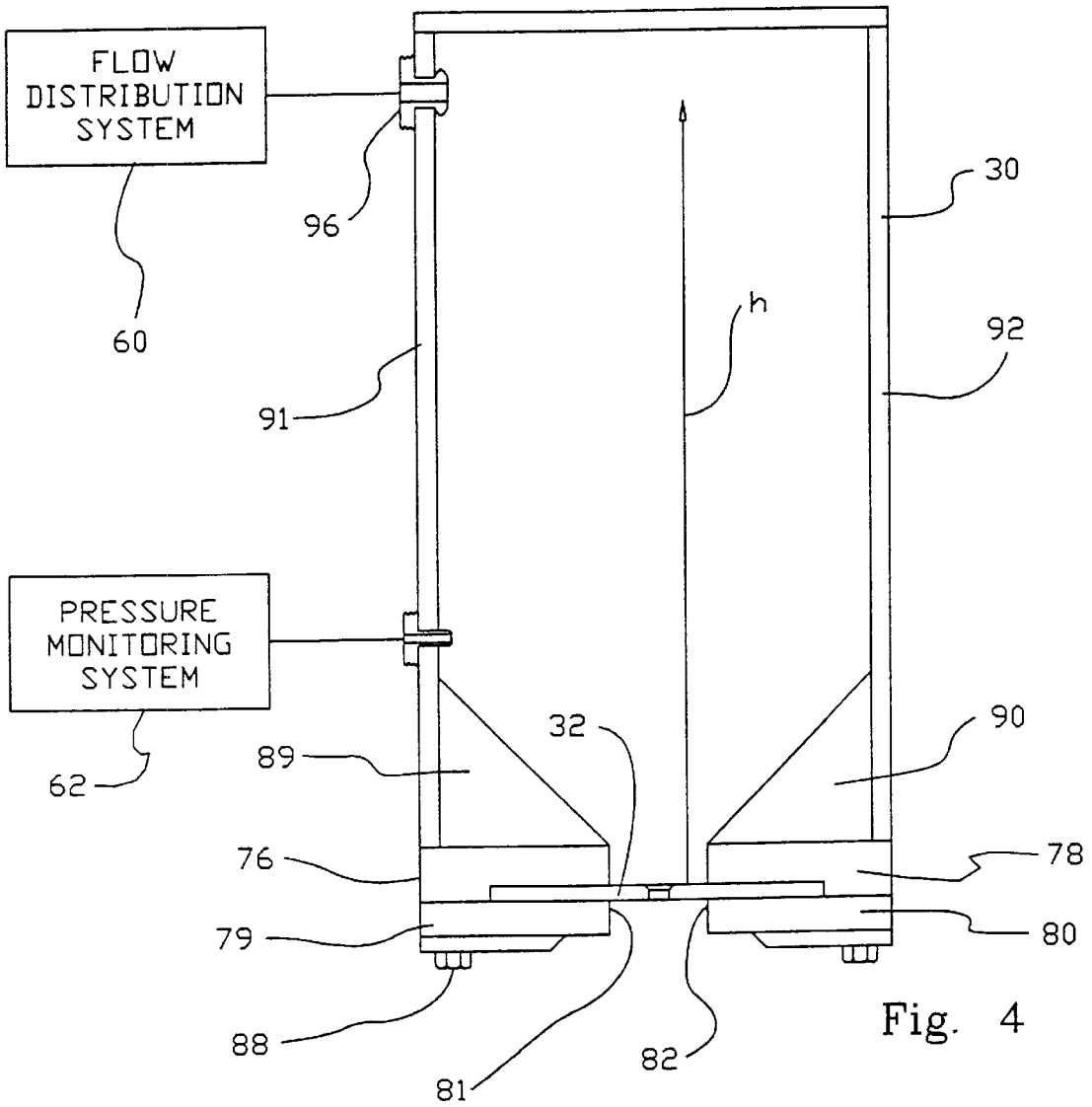
FIG. 4 is a cross-sectional view of the chamber box taken at line IV—IV in FIG. 2.

Referring now to FIG. 4, the chamber box 30 includes at its bottom portion 76 a slotted base plate 78 and first and second wear strips 79 and 80, which in cooperation with the base plate 78 define a pair of opposing, elongate slots 81 and 82 which slidingly receive edge portions of the endless belt 32. Preferably, the elongate slots 81 and 82 are formed along a central bottom portion of the base plate 78, but alternatively, could be formed at least partially or wholly in the wear strips 79 and 80.

The central slot 84 in the base plate 78 terminates within the confines of the chamber box 30 adjacent to the end portions 50, 50' of the chamber box 30. Preferably, each terminus of the central slot 84 is scalloped so as to avoid the accumulation of slurry solids at those locations. The width of the central slot 84 is minimized so as to minimize exposure of the fluid within the chamber box 30 to the pumping action of the belt 32. In the preferred embodiment, the slot is approximately ⅜ inch wide, whereas the diameter of the orifices 44 in the endless belt 32 are preferably approximately 3/32 inch.

Each of the wear strips 79, 80 extend along opposite sides of the bottom portion 76 of the slurry box 30, co-extensively with the base plate 78. An elongate shim 86 and a plurality of spaced apart fasteners 88 (preferably bolts) affix the wear strips 79,80 to the adjacent, superposing portion of the base plate 78.

The tolerances between the respective edge portions of the belt 32 and the slots 81, 82 are to be minimized so as to promote sealing of the bottom portion 76 of the chamber box 30. However, the fit between the belt 32 and the slots 81,82 should not be so tight as to foment binding of the endless belt 32 in the slots 81, 82. In the preferred embodiment, these countervailing considerations are met when the slots 81, 82 are configured to present a 1/16 inch total tolerance in a width-wise direction across the endless belt 32. In the direction normal to the plane of the belt, the belt has preferably a thickness 0.020 inch, whereas the slots 81, 82 are 0.023 inch deep. These relationships achieve the desired balance of proper sealing and the need for facile passage of the belt 32 through the bottom portion 76 of the chamber box 30.

Preferably, the wear strips 79, 80 are constructed from ultra high molecular weight polyethylene or Dalron.

Included within the confines of the chamber box 30 are bevelled inserts 89, 90 which extend along and fill the corners defined between the base plate 78 and each of the vertical walls 91, 92 of the chamber box 30. The inserts preferably present a 45 degree incline from the vertical walls 91, 92 toward the central slot 84 of the base plate 78. This arrangement avoids stagnation of fluid in the confines of the chamber box 30, which would otherwise tend to accumulate the solid content of the slurry and possibly clog the chamber box 30 and the orifices 44 of the endless belt 32.

Near the bottom portion 76 of the chamber box 30, a plurality of spaced-apart pressure ports 94 communicate the pressure monitoring system 62 with the interior of the slurry box 30. The pressure monitoring system 62 was previously mentioned with reference to FIG. 1A and will be discussed in further detail in reference to FIGS. 9 and 10.

Along the upper portion of the chamber box 30, a plurality of spaced-apart feed ports 96 are located along the vertical wall 91. The feed ports 96 communicate the flow distribution system 60 with the interior of the slurry box 30. Preferably, the feed ports 96 are located close to the lid plate 31 of the chamber box 30. The flow distribution system 60 has been noted in reference to FIG. 1 and will be discussed further detail in reference to FIGS. 9 and 11.

The feed ports 96 are spaced vertically by a distance h above where the endless belt 32 traverses through the bottom portion 76 of the chamber box 30. The feed ports 96 introduce slurry into the chamber box 30 in a substantially horizontal direction. The vertical placement and the horizontal orientation of the ports 96 dampened vertical velocities in the fluid at or about the region of endless belt 32 at the bottom portion 76 of the chamber box 30. The arrangement also decouples the discharge flows 40 through the orifices 44 from the inlet flows at the feed ports 96.

The height h in the preferred embodiment is approximately 8 inches or more; however, the vertical distance h between the feed ports 96 and the endless belt 32 may be as little as 6 inches. With greater distances h, there is lesser disturbance and interaction between the fluid adjacent the endless belt 32 and the fluid conditions at the feed ports 96.

In the preferred embodiment, the number of feed ports 96 amounted to twelve (12), but the invention is workable with as few as 6 inlet feed ports 96. Although not preferred, the invention could be practiced possibly with as few as 4 inlet feed ports 96. The number of feed ports 96 depends upon the width of the paper making machine in any particular application. The preferred spacing between the feed ports 96 is approximately 12 inches and preferably not greater than approximately 24 inches, although it is possible to operate with even greater separation.

Figure 5:
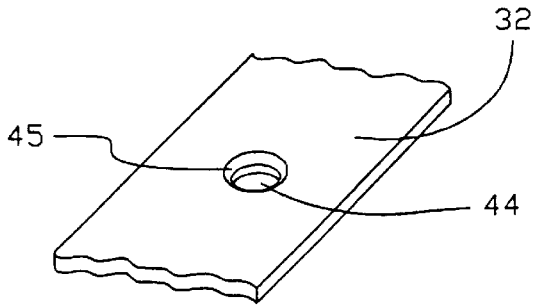
FIG. 5 is a detail perspective view of the endless belt of the applicator shown in FIG. 2.

Referring now to FIG. 5, each of the orifices 44 along the endless belt 32 include a bevelled portion 45 adjacent the side of the endless belt 44 facing into the chamber box 30. By such arrangement, the solids content of the slurry is not allowed to collect at or about the orifices 44 during operation of the applicator 10. More particularly, slurry fiber is not allowed to collect about the orifice and deflect the jets of slurry being discharged. Accordingly, the bevelled portions 45 of the orifices 44 promote consistent delivery of slurry from the applicator 10 and reduce malfunctions and maintenance.

Figure 6:
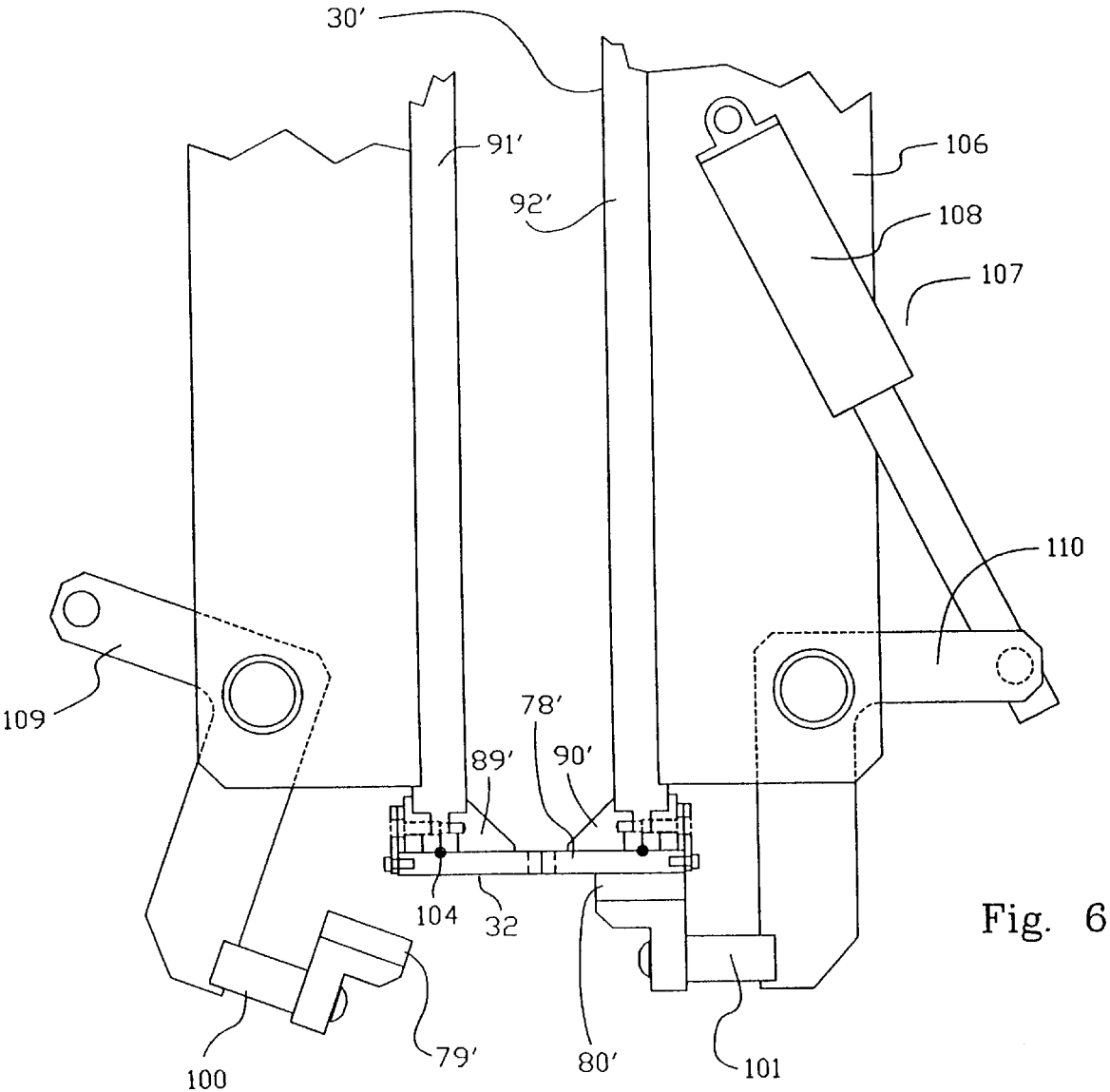
FIG. 6 is a detail, partial sectional view of an alternate embodiment of a chamber box of the applicator of FIG. 2.

Referring now to FIG. 6, in an alternate embodiment of the chamber box 30', the vertical walls 91', 92', together with the base plate 78' and inclined bevelled elements 89', 90' cooperate with a retractable armature 100, which at its operative end portion supports an elongate wear strip 102. The elongate wear strip 102 extends the length of the chamber box 30' and is supported at spaced locations along each side of the chamber 30' by a plurality of retractable armatures 100 and 101. In this embodiment, the wear strips 79' and 80' are mounted upon and are retractable with the armatures 100 and 101, respectively. In FIG. 6, the armatures 100 along one side of the chamber box 30 are shown in a retracted position, while the armatures 101 along the opposite side of the chamber box 30' are shown in an engaged position, where the respective wear strip 90' is biased against the base plate 78'. In actual operation, the armatures 100 and 101 are pivoted between the retracted and engaged positions simultaneously.

Each retractable armature 100, 101 is pivotally mounted upon one or a pair of vertical flanges 106, which preferably provides support for an actuator mechanism 107 for moving the retractable armature 100, 101 from an operative, engaging position where the wear strips 89', 90' are urged against base plate 78' to a retracted position where the wear strips 89', 90' are spaced away from the base plate 78' and the endless belt 32'.

The actuator mechanism 107 is preferably an air cylinder 108 which is operatively connected to the pivot arms 109, 110 of the armatures 100 and 101, respectively. Other mechanical expediencies could be selected for pivoting the retractable armatures 100 and 101, as would be readily apparent to one of ordinary skill in the art upon reading this disclosure.

An elastomeric seal 104 is provided between the lower portions of the chamber box walls 91', 92' and the base plate 78' so as to create a fluid-proof seal about the entire periphery of the base plate 78'.

In operation, all of the armatures 100, 101 along both sides of the chamber box 30' are pivoted simultaneously so that the wear strips 79', 80' are moved as units to and from their operative and engaged positions. The retractable armatures 100, 101 facilitate quick and speedy maintenance, repair and/or replacement of the endless belt 32', the wear strips 79', 80' and the base plate 78'.

Figure 7:
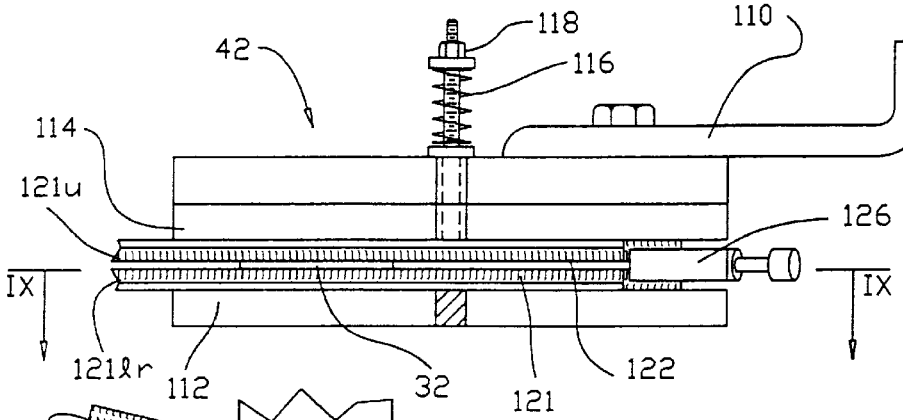
FIG. 7 is an end view of the cleaning station of the moving orifice applicator shown in FIG. 2.
Figure 8:
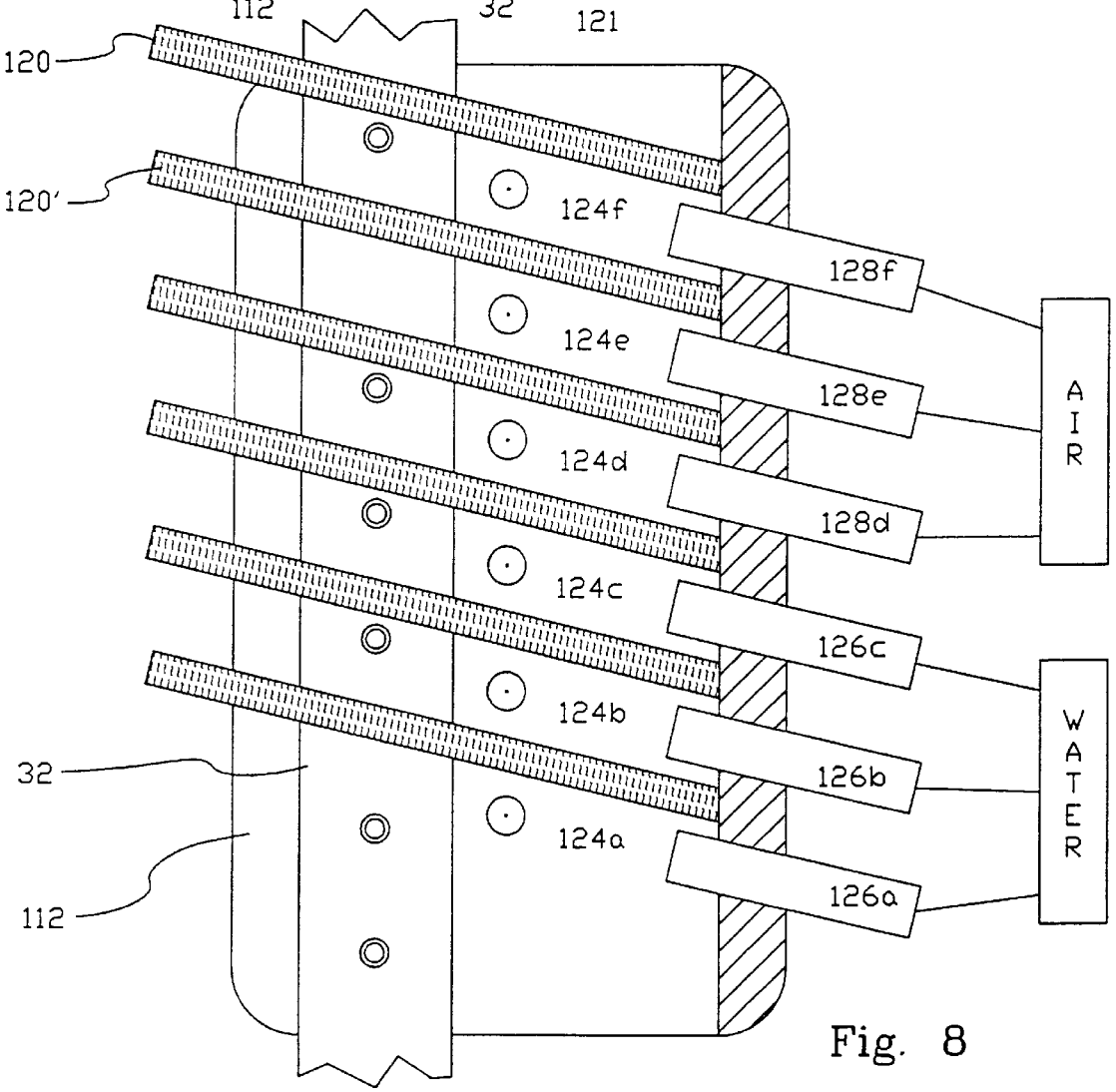
FIG. 8 is sectional top view of the cleaning station shown in FIG. 7.

Referring now FIGS. 2, 7 and 8, after progressing through the chamber box 30, the endless belt 32 enters the cleaning box 42 which is arranged to sweep away any entrained slurry that may have been carried from the box 30 by the belt 32. Preferably, the cleaning box 42 is supported from the planar frame member 72 by a bracket 110 and includes an upper and lower plate 112 and 114 which are connected to one another so as to be biased toward each other by a spring 116 so as to create a moderate positive clamping action toward the belt 32. The biasing action of the spring 116 is adjustable by conventional arrangement such as by a nut 118. The biasing spring 116 creates a clamping action of the plates 112, 114 upon pairs of fibrous wiper elements 120, each which receive the endless belt 32 between its upper wiper element 121*u* and its lower wiper element 121*lr*. In the preferred embodiment, these pairs wiper elements 120 are six in number, parallel to one another and arranged at an oblique angle relative to the pathway of the endless belt 32. Preferably, each of the upper and lower wiper elements 121*u* and 121*lr* comprise cotton roping of approximately ¼ to ½ each diameter. The endless belt 32 passes between the upper and lower wipers 121*u*, 122*lr* of each pair of wiper elements 120. The pairs of wiper elements 120 sweep slurry material from the endless belt 32 as it passes therebetween. Referring particularly to FIG. 8, adjacent pairs of wiper elements 120 and 120' defined channels 124' therebetween for directing fluid across the endless belt 32 to purge extraneous slurry material away from the endless belt 32 as it passes through the cleaning box 42.

In the preferred embodiment, water is introduced through the first 3 channels 124*a–c* from nozzles 126*a–c* to flush the belt 32 with water. Thereafter, a plurality of air jet nozzles 128*d–f* direct airstreams out channels 124*d–f* to sweep extraneous water and any remaining slurry from belt 32. Preferably, the drying box 42 is operated such that the belt 32 is entirely dry before it reaches the drive wheel 34 so that the drive wheel 34 does not collect and throw slurry and/or water about the adjacent environment.

Preferably, water is supplied to the water nozzle 126*a* at approximately 3 liters per minute (minimum) to the nozzle 126*b* at approximately 2 liters per minute (minimum) and to the nozzle 126*c* at approximately 1 liter per minute (minimum).

Figure 9:
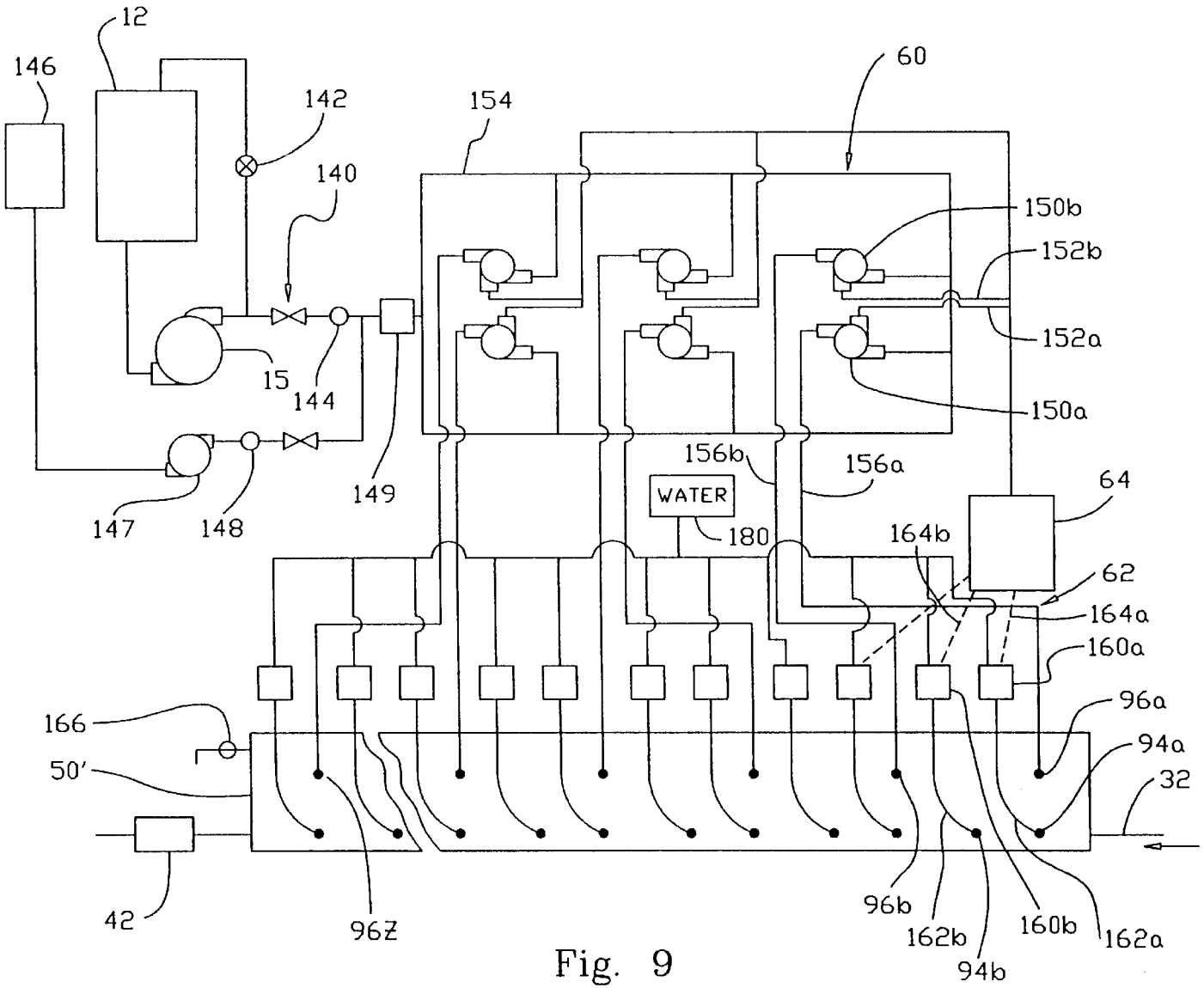
FIG. 9 is a schematic layout of the chamber box, together with the flow distribution system and the pressure monitoring system of the preferred embodiment shown in FIG. 2.

Referring to FIG. 9, as previously described, slurry from the day tank 12 is delivered to the flow distribution system 60 by a main, circulation pump 15. Preferably, exit pressure from the main circulation pump 15 is controlled by an appropriate arrangement 140 such as a pressur control valve 142 and a flowmeter 144 such that slurry is delivered to the flow distribution system 60 at a predetermine pressure, preferably in the range of approximately 50 to 70 psig (most preferably approximately 60 psig), and in the preferred embodiment, preferably in the range of 4 to 10 gallons per minute, more preferably approximately 5 gallons per minute.

Optionally, a supply of chalk that is stored in a chalk tank 146 is introduced into the add-on slurry at a location downstream of the flowmeter 144, under the control of a chalk metering pump 147 and chalk flowmeter 148. Preferably, the arrangement includes a static mixer 149 to provide uniform mixing of chalk into the main slurry stream.

The slurry flow from the day tank 12 and the main circulation pump 15 is delivered to the flow distribution system 60, which will now be described with reference to the first two of a larger plurality of metering pumps 150 so that unnecessary duplication of description and designations is avoided.

The flow distribution system 60 preferably comprises a plurality of metering pumps 150 (e.g. 150*a* and 150*b*), which are each operatively controlled by their connections 152 (e.g. 152*a* and 152*b*) to the controller 64, such that signals from the controller 64 can control each pump speed (and therefore flow rate) individually and selectively. Each of the metering pumps 150*a*, and 150*b* are each individually communicated with the main circulation pump 15 via a flow circuit 154. The discharge end of each of the pumps 150*a* and 150*b* are connected (communicated) to one of the feed ports 96 (e.g. 96*a* and 96*b*), respectively such that preferably each metering pump 150 singularly delivers slurry to one of the associated feed ports 96. This arrangement is replicated throughout the plurality of metering pumps 150 so that each of the individual feed ports 96 along the length of the chamber box 30 are connected with one of the metering pumps 150. The pumps 150*a* and 150*b* are communicated to the feed ports 96*a* and 94*b* through lines 156*a* and 156*b*, respectively.

Accordingly, by such arrangement a signal from the controller 64 to the first metering pump 150*a* might establish a pump speed at the metering pump 150*a* which delivers a controlled flow rate from the metering pump 150*a* to the first feed port 94*a* under individual, possibly differentiated rate from the flow rates delivered by the other metering pumps 150*b–z* to the other feed ports 94*a*.

The control signals from the controller 64 are predicated upon processing of signals received from each of the pressure sensors 160 of the flow monitoring system 62. For sake of clarity and avoidance of unnecessary duplication of description and designations, the flow monitoring system 62 will be described in reference to the first and second pressure sensors 160*a* and 160*b*.

Each pressure sensor 160 (e.g. 160*a* and 160*b*) is communicated with one of the pressure ports 94 through a conduit 162 (e.g. 162*a* and 162*b*, respectively). Each of the pressure sensors 160 (e.g. 160*a* and 160*b*) is communicated with the controller 64 through electrical connections 164 (e.g. 164*a* and 164*b*, respectively).

Such arrangement is repeated for each of the pressure sensors 160 such that each of the pressure ports 94*a* through 94*z* are communicated with a pressure sensor 160 which sends a signal indicative of a local static pressure in the chamber box 30 to the controller 64.

In the preferred embodiment, the number of feed ports 96 numbered twelve (12) and the pressure ports 94 numbered twenty-four (24). Accordingly, pairs of pressure ports 94 were arranged adjacent each feed port 96 (of course, subject to the vertical spacing between the feed ports 96 and the pressure ports 94). It is contemplated that the invention is readily practiced with even greater numbers of pressure ports 94 and feed ports 96 or far fewer of the same. In an alternate embodiment, the feed ports 96 numbered six (6) and the pressure ports 94 numbered twelve (12). The invention is operable with even fewer. The total number of feed ports 96 will depend upon the length of the chamber box 30, with spacing between adjacent feed ports 96 being established at less than approximately 24 inches, and preferably about 12 inches.

Preferably, the chamber box 30 is operated in a fully filled condition and includes a pressure relief valve 166 at the end portion 50' of the chamber box 30 adjacent the cleaning box 42. The pressure relief valve 166 is provided as a precaution against an undesired build-up of fluid pressure within the chamber box 30.

Preferably, the metering pumps 150 of the flow distribution system are mounted apart from the remainder of the moving orifice applicator, such as on a separate stand at one end of the moving orifice applicator 10. Preferably, the pressure sensors 160 are supported from the planar frame member 72 of the moving orifice applicator 10. The metering pumps 150 are preferably a progressive cavity type of pump, such as a Model NEMO/NE Series from Nezsch Incorporated of Exton, Pa. A host of other equally suitable pumps could be used instead.

Figure 10:
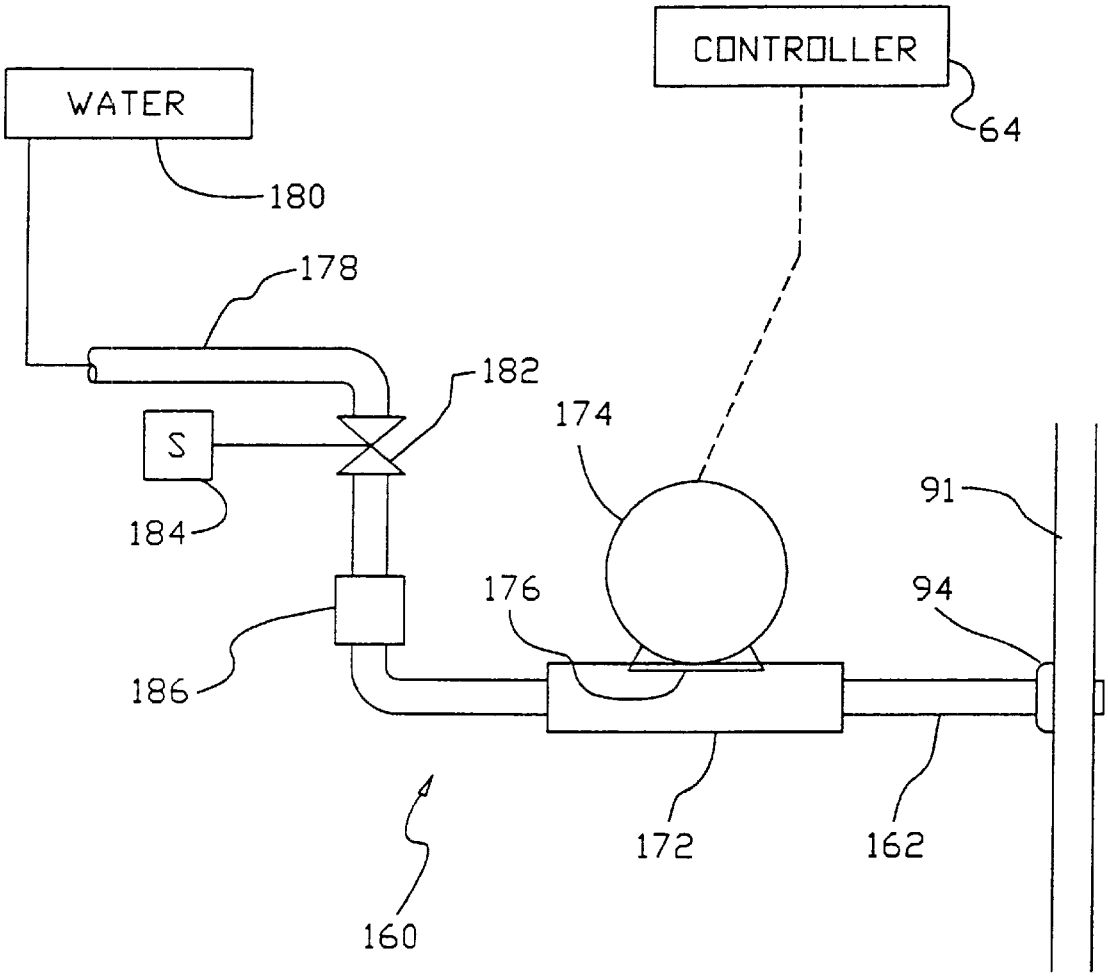
FIG. 10 is a schematic of a preferred pressure sensor arrangement of the moving orifice applicator shown in FIG. 2.

Referring now to FIG. 10, each pressure sensor 160 comprises a first conduit 162 which communicates a respective sensor port 94 with a chamber 172. A pressure transducer 174 includes a pressure deflectable membrane 176 in operative communication with the pressure chamber 172. A second line 178 communicates the chamber 172 with a source of water 180. A control valve 182 at a location along the conduit 178 is opened and closed selectively by a two-way solenoid 184 so as to control the introduction of water from the source 180 through the conduit 178, the chamber 172 and the conduit 162 for filling those elements with water and for flushing during shut-down and maintenance. During operation of the moving orifice applicator 10, the control valve 182 remains closed so as to maintain a column of water extending from the control valve 182 through the remainder of the conduit 178, the chamber 172 and the conduit 162. A check valve 186 at a location along the conduit 178 between control valve 182 and the chamber 172 prevents an undesired backflow of fluid into the control valve 182 or the water supply 180.

Figure 11:
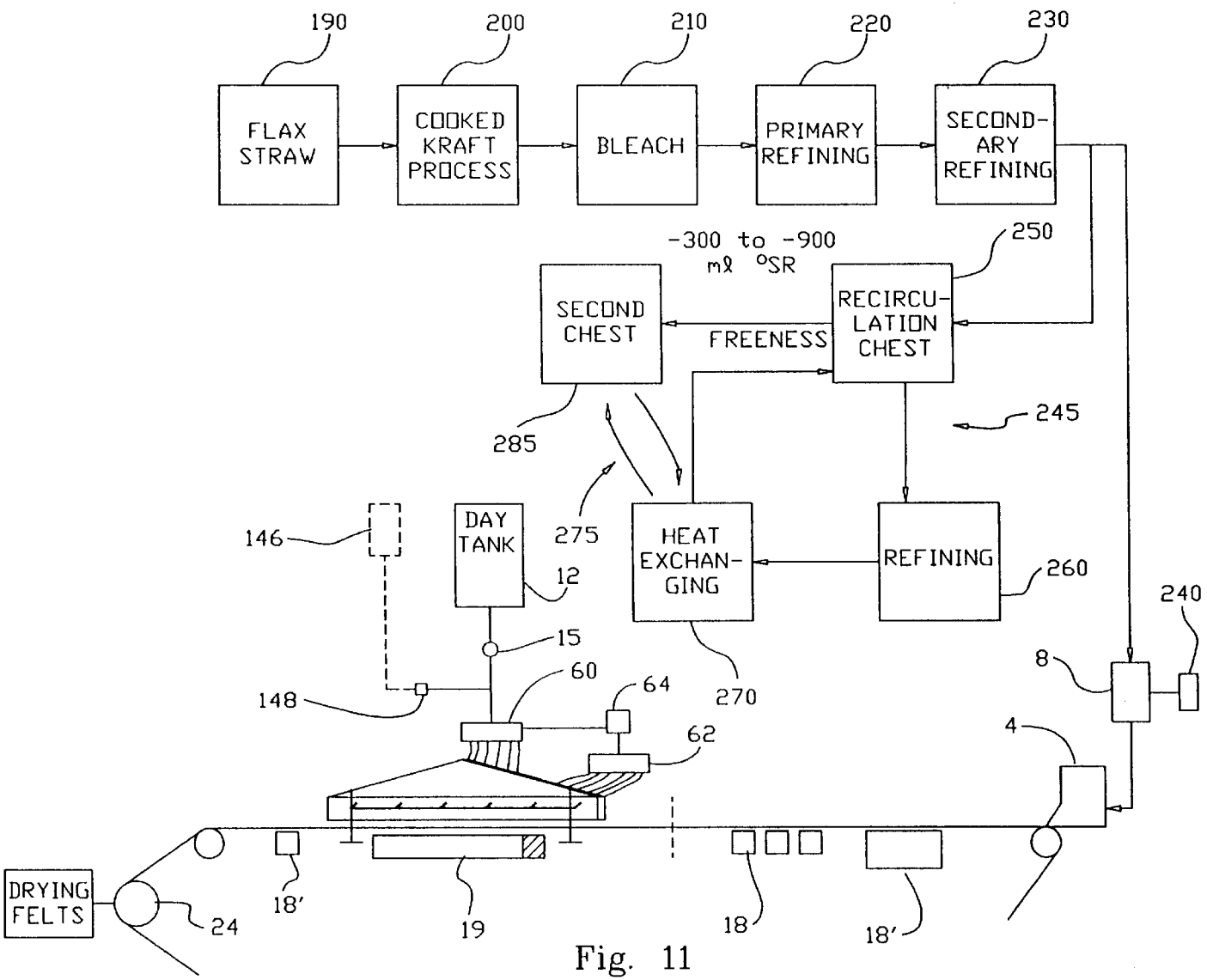
FIG. 11 is a schematic diagram of a moving orifice applicator system as shown in FIG. 1, together with a representation of the preferred steps in the preparation of the pulp slurries of the base web and the add-on material.

Referring now to FIG. 11, the preparation of the slurry for the production of the cigarette paper using the moving orifice applicator 10 initiates with the cooking of flax straw feed stock 190, preferably using the standard Kraft process that prevails in the paper making industry. The cooking step is followed by a bleaching step 210 and a primary refining step 220. Preferably, the preferred process includes a secondary refining step 230 before the majority of the refined slurry is directed to the run tank 8 of the headbox 4. Preferably, the refining steps 220 and 230 are configured to achieve a weighted average fiber length in the flax slurry of approximately 0.8 to 1.2 mm, preferably approximately 1 mm. Preferably, a chalk tank 240 is communicated with the run tank 8 so as to establish a desired chalk level in the slurry supplied to the headbox 4.

Preferably, a portion of the slurry from the second refining step 230 is routed toward to a separate operation 245 for the preparation of an add-on slurry for application by the moving orifice applicator 10. This operation 245 begins with the collection of refined slurry in a recirculation chest 250 wherefrom it is recirculated about a pathway including a multi-disc refining step 260 and a heat exchanging step 270 before returning to the circulation chest 250. Preferably, in the course repeating the refining step 260 and the heat exchanging step 270, heat is removed from the slurry at a rate sufficient to prevent a runaway resculation of temperature in the slurry, and more preferably, to maintain the slurry at a temperature that is optimal for the refining step 260, in the range of approximately 135 to 145° F., most preferably approximately 140° F. for a flax slurry. The add-on slurry is recirculated along this pathway of steps 250, 260, 270 and back to 250 until such time that the add-on slurry achieves a Freeness value of a predetermined value in the range of approximately −300 to −900 milliliter °Schoppler-Riegler (ml °SR). The upper end of the range is preferable (near−750 ml °SR).

An explanation of negative freeness values can be found in "Pulp Technology and Treatment for Paper", Second Edition, James d' A. Clark, Miller Freeman Publications, San Francisco, Cailf. (1985), at page 595.

Upon completion of the recirculation operation, the extremely refined add-on slurry is ready for delivery to the day tank 12 associated with the moving orifice applicator 10, wherefrom it is distributed along the length of the chamber box 30 of the moving orifice applicator as previously described. However, it is usually preferred to undertake a further recirculation step 275 wherein the add-on slurry is recirculated from the second chest 285 again through the heat exchanger (of step 270) with little or no further refining so as to achieve a desired final operational temperature in the add-on slurry (preferably, approximately 95° F.) prior to delivery to the day tank 12 and the applicator 10. Accordingly, the heat exchanger is preferably configured to serve at least dual purposes, to maintain an optimal temperatures in the add-on slurry as it is recirculated through the refiners and to remove excess heat in the add-on slurry at the conclusion of refining steps in anticipation of delivery to the applicator 10.

The second slurry chest 285 also accommodates a semi-continuous production of slurry.

Preferably, the multi-disc refining 260 of the recirculation pathway is performed using refiners such as Beloit double multi-disc types or Beloit double D refiners. The heat exchangers used in the step 270 of the recirculation pathway avoid the build-up of heat in the slurry which might otherwise result from the extreme refining executed by the multi-disc refiners in step 260. Preferably, the heat exchanger is a counter-flow arrangement such as a Model 24B6-156 (Type AEL) from Diversified Heat Transfer Inc. For the preferred embodiment, the heat exchanger of step 270 is configured to have a BTU rating of 1.494 MM BTU per hour.

Fines levels in the add-on slurry range from approximately 40–70% preferably about 60%. Percentiles of fines indicate the proportion of fibers of less than 0.1 mm length.

Preferably, the slurry that is supplied to the head box 4 (the "base sheet slurry") is approximately 0.5% by weight solids (more preferably approximately 0.65%); whereas the slurry that is supplied to the moving orifice applicator 10 (the "add-on slurry") is preferably at approximately a 2 to 3% by weight solids consistency. For flax pulp, the Freeness value of fibers in the in the base sheet slurry at the head box 4 is preferably in the range of approximately 150 to 300 ml °SR, whereas the add-on slurry at the chamber box 30 is preferably at a Freeness value in the range of approximately −300 to −900 ml °SR, more preferably at approximately −750. Preferably, the solids fraction of the base sheet slurry is approximately 50% chalk and 50% fiber, whereas in the add-on slurry, the relationship is approximately 10% chalk (optionally) and 90% or more fiber. Optionally, the add-on slurry may include a 5 to 20% chalk content, preferably a Multiflex that is obtainable from Speciality Minerals, Inc.

Figure 1B:
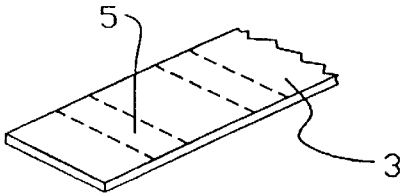
FIG. 1B is a perspective view of a paper constructed in accordance with the methodologies and apparatus of the present invention.
Figure 1C:
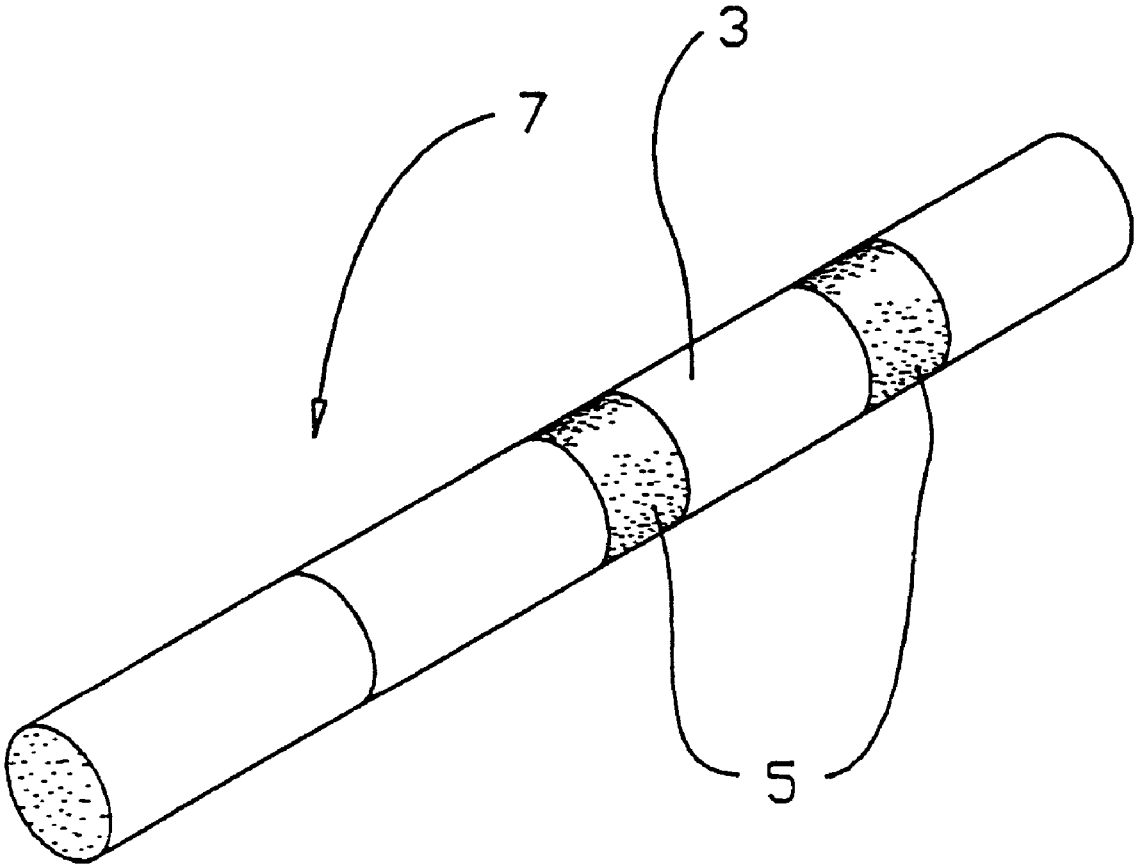
FIG. 1C is a perspective view of a cigarette constructed with the paper of FIG. 1B.

As previously described in reference to FIG. 1A, the add-on slurry is applied to the base web by the applicator 10, whereupon water is further removed and the sheet is dried upon passage through the drying felts 26. Referring now also to FIG. 1B, at the conclusion of the paper making process, a paper is constructed having a base sheet portion 3 and a plurality of uniformly applied, uniformly spaced, mutual parallel banded regions 5 of highly refined add-on cellulosic material of weighted average fiber length in the range of approximately 0.15 mm to 0.20 mm. In these banded regions 5, the cigarette paper has a reduced air permeability in comparison to that of the regions of the base sheet 3 between the banded regions 5. Referring now also to FIG. 1C, the paper is wrapped about a column of tobacco to form the tobacco rod of a cigarette 7, which will at the banded regions exhibit a slower burn rate in comparison to those regions of the base sheet 3 between the banded regions 5.

The operation of the cigarette paper making machine and method of the preferred embodiment has been described with respect to flax feedstock. The apparatus and associated methodologies are readily workable with other feedstocks such as hardwood and softwood pulps, eucalyptus pulps and other types of pulps used in the paper making industry. The alternate pulps may have different characteristics from flax, such as differences in averge fiber length, which may necessitate adjustment of the degree of refining in steps 220 and 230 in the preparation of the base sheet slurry with some pulps. With an alternative pulp, it may be acceptable to skip one or both of the refining steps 220 and 230, particularly if the pulp exhibits a very short average fiber length in comparison to flax. However, in order for the preparation of the add-on slurry to progress satisfactorily, the slurry which is to be diverted to the recirculation chest 250 should exhibit an initial weighted average fiber length approximating that previously described for the refined flax base sheet slurry, that is, having a weighted fiber length of approximately 0.7 mm to 1.5 mm and more preferably aproximately 0.8 mm to 1.2 mm. With these alternative pulps, the add-on slurry is recirculated through the refining step 260 and the heat exchanging step 270 until a comparable desired Freeness value is obtained (in the range of −300 to −900 ml °SR, preferably approximately −750 ml °SR). As with flax, the extreme degree of refining of the add-on slurry avoids fiber build-up at or about the orifices 44 or the belt, which in turn avoids jet deflections at the orifices 44.

Figure 12A:
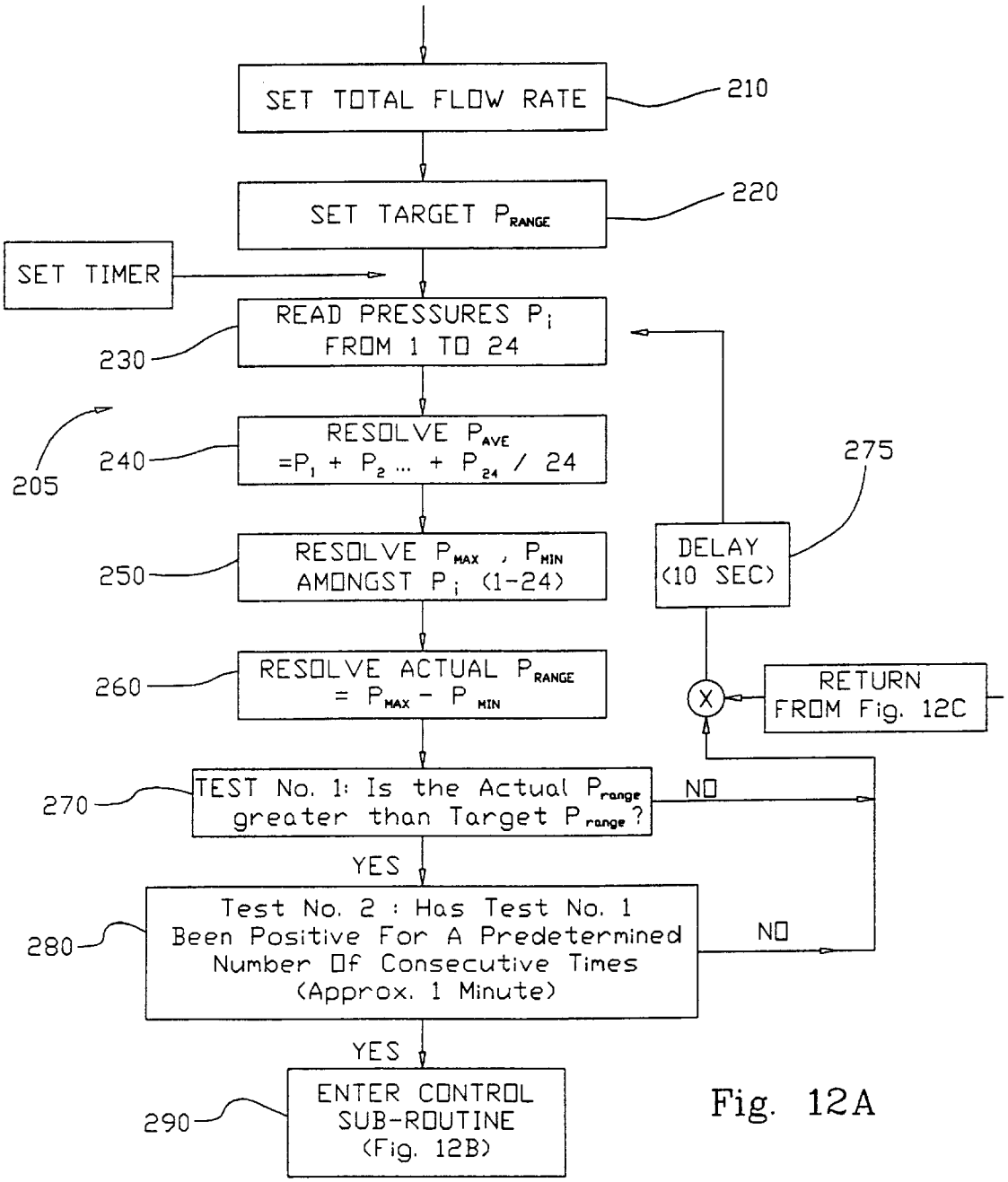
FIGS. 12A, 12B and 12C are diagrams of a preferred control logicsequence for the controller of the moving orifice applicator shown in FIG. 2.
Figure 12B:
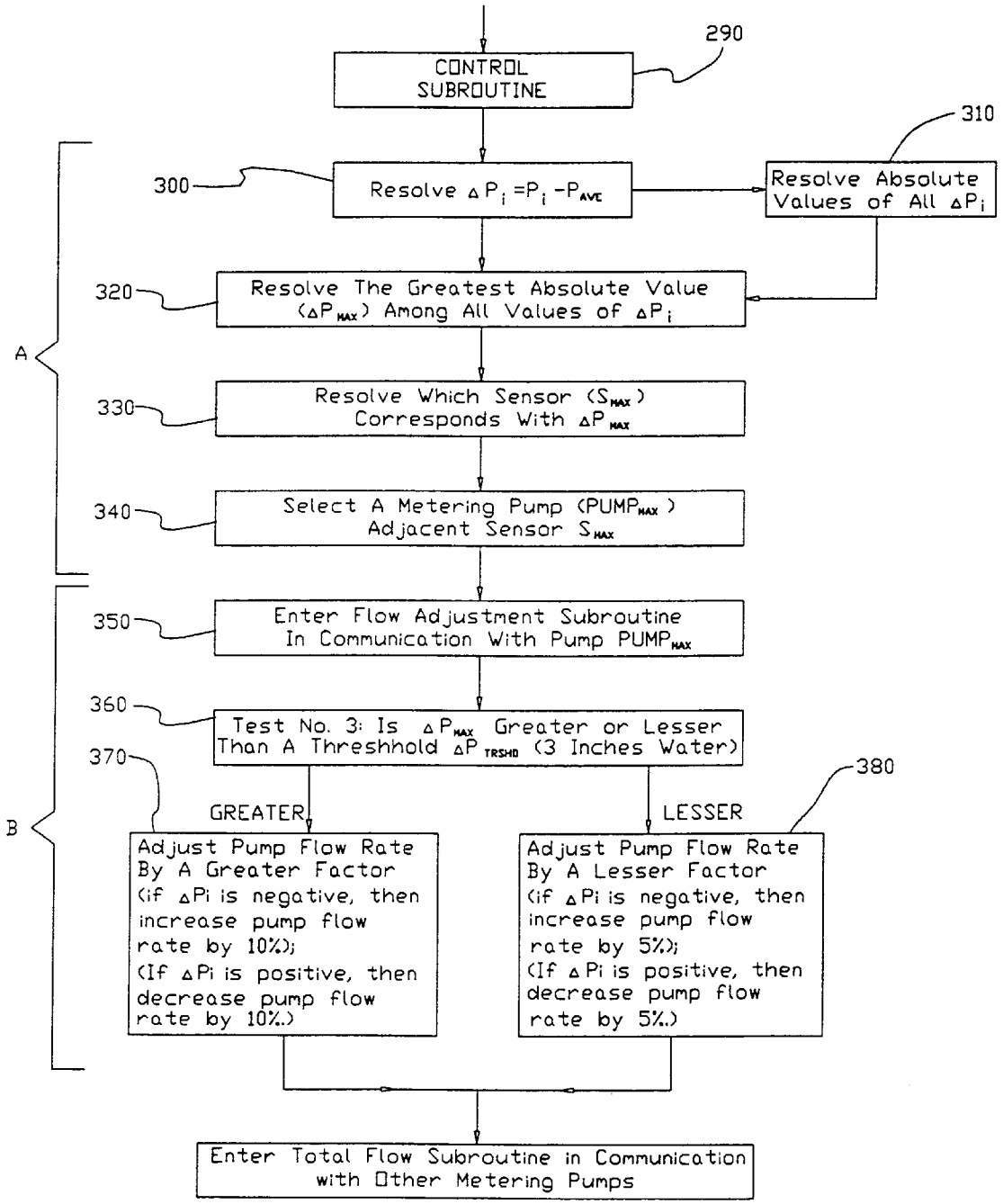
Figure 12C:
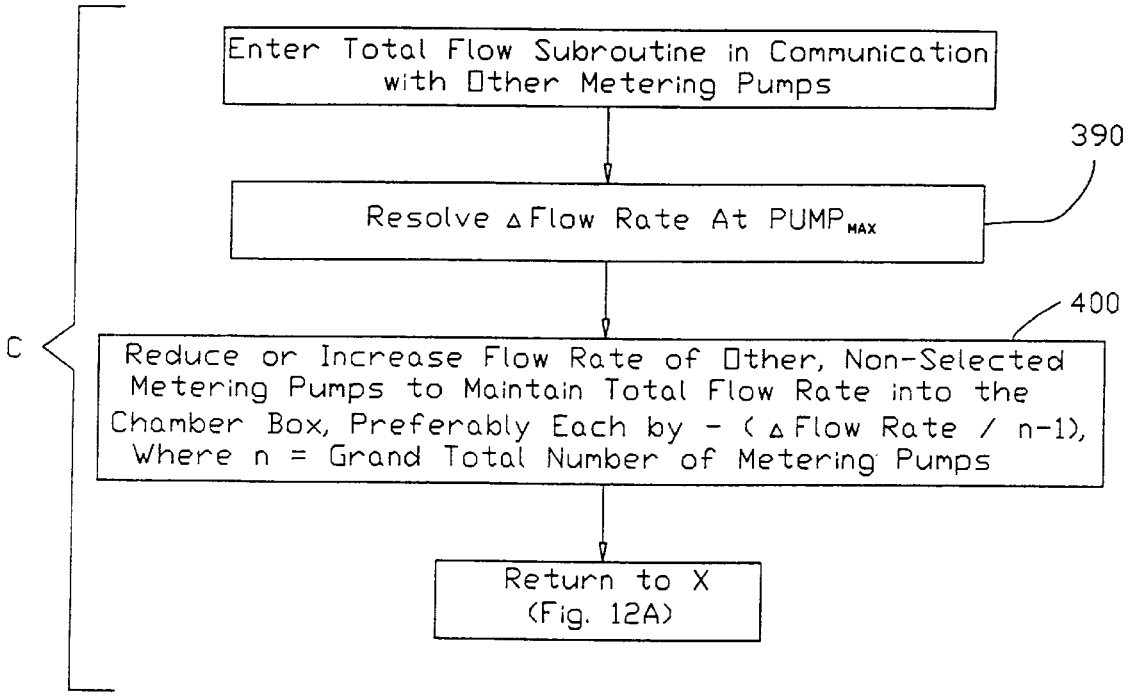

Because the flow of the fluid stream 40 emanating from each orifice 44 as the orifice 44 passes along the bottom portion of the chamber box 30 is proportional to the pressure differential across the orifice 44, it is imperative that fluid pressure be established and then held as uniformly as possible along the entire journey of each orifice 44 along the bottom portion 76 of the chamber box 30. The discussion which follows with reference to FIGS. 12A–C provide the preferred control logic operation for execution by the controller 64 in operating the flow distribution system 60 responsively to the pressure monitoring system 62 such that uniformity is achieved in the discharge streams 40 from each orifice 44 as they journey along the bottom portion 76 of the chamber box 30.

Fundamentally, the controller 64 preferably executes a fuzzy logic control operative which is predicated upon the following rules:

1. total slurry flow into the chamber box 30 will be maintained at a predetermined, grand total flow rate;

2. all metering pumps will be operated initially at the same speed/flow rate to deliver the desired total flow rate;

3. because the metering pumps 150 will operatively confound each other, adjustments in pressure will be undertaken locally with only a small subset of the total number of pumps, such as one or two metering pumps 150 at a time (or optionally from one to five or more, depending on the size of the chamber and/or the number of metering pumps);

4. no adjustment will be undertaken if the variance in pressure readings along the chamber box 30 falls within a predetermined, acceptable level (or threshold);

5. a local adjustment in pressure (by adjusting the pump speed of a selected metering pump 150) will be undertaken only upon a demonstration that the causal local condition (a low or high pressure perturbation beyond the predetermined threshold) has persisted for a predetermined amount of time;

6. that the degree of adjustment will be scaled relative to the magnitude of the perturbation such that detection of a small scaled, persistent perturbation will necessitate a small adjustment and detection of a large scaled, persistent perturbation will necessitate a large adjustment; and 7. even after an adjustment, further adjustments will not occur until after the condition persists for predetermined amount of time as set forth in step 5.

Referring now to FIG. 12A, the controller 64 preferably executes steps which initiate with setting the total flow rate (step 210), which in the preferred embodiment may be in the range of 5 or 6 gallons slurry per minute for a typically sized paper making machine. Larger machines may require larger flow rates. Additionally, in a step 220 a target range of pressure ("$P_{range}$") is established, which in the preferred embodiment identifies a total range of variation in pressure along the chamber box 30 that is acceptable for proper and consistent operation of the moving orifice applicator 10. As way of non-limiting example, the pressure range of variation may be selected to the 1.5 inches of water or less when the operational pressure at the bottom portion 76 of the chamber box 30 is established at or about 6 to 18 inches water (more preferably, approximately 6 to 8 inches of water).

Once the total flow rate and $P_{range}$ have been established, the controller 64 executes a first subroutine 205 to resolve whether flow conditions in the chamber box 30 warrant an adjustment in the flow rate of any of the metering pumps 150. The subroutine 205 begins with the pressure monitoring system 62 being tapped in a step 230 to read each of the plurality of pressures along the pressure ports 94. In the preferred embodiment, 24 pressure readings would be undertaken in step 230. All these pressure values ("$P_i$") are used to calculate an average pressure ("$P_{ave}$") in a step 240. Also the controller 64 resolves which amongst all the values of pressure ($P_i$) is the highest pressure reading ("$P_{max}$") and which is the lowest pressure reading ("$P_{min}$"). In a step 260, the controller 64 resolves a value for the actual pressure range from the difference between $P_{max}$ and $P_{min}$. A test ("Test No. 1") is then conducted in a step 270 which compares the actual pressure range to the target pressure range that had been predetermined in step 220. If the actual pressure range is less than the target pressure range, the fluid conditions in the chamber box 30 are nominal and the controller 64 sets itself to execute a timing step 275 which creates a 10 second delay before looping back to the pressure reading step 230 to repeat this sub-routine to again check the acceptability of variance in the new set of pressure readings $P_i$ throughout the length of the chamber box 32.

If the actual pressure range is greater than the target pressure range, then the logic circuit proceeds to the next test 280 ("Test No. 2") which determines whether this (positive) result of the first test has persisted for a predetermined time, such as being repeated consecutively for one minute (i.e., 6 consecutive occurrences in view of the 10 second delay created in step 275 between each pressure reading step 230). If this Test No. 2 has not been met, then the logic circuit sets itself to execute the timing step 275 before looping back to the pressure reading step 230. If the Test No. 2 has been positive for a pre-determined number of consecutive times, then the logic circuit enters a flow control subroutine 290.

Referring now to FIGS. 12B and 12C, the flow control subroutine 290 preferably includes a first logic regime A which undertakes to resolve which one of the metering pumps 150 is to have its speed (and therefore its flow rate) adjusted to overcome the non-uniformities in pressure readings along the chamber box 30. The logic regime A adjusts the speed of whichever pump 150 will contribute the greatest impact on the pressure profile along the chamber box 30. A second logic regime B resolves whether conditions are such that a greater magnitude in adjustment in pump flow must be undertaken or whether a lesser adjustment is to be executed. A final logic regime C resolves how all of the remaining metering pumps 150 are to be adjusted (preferably equally) so that the total flow rate delivered by the flow distribution system 60 into the chamber box 30 is maintained at the predetermined value established in step 210. Upon execution of logic regimes A through C, the controller returns back to the timing step 275 for the ten second delay and then to the pressure reading step 230 to reinitiate pressure readings.

The logic regime A includes the steps of resolving at each pressure port 94 a pressure differential ("$\Delta P_i$") between the respective pressure reading Pi and the average pressure calculated in step 240. Absolute values of these pressure differentials $\Delta P_i$ are then resolved in a step 310 and compared such that a resolution of the greatest absolute value among all values of pressure differentials $\Delta P_i$ is ascertained. The controller 64 then executes steps 330 and 340 to identify which metering pump 150 is operatively adjacent the pressure port 94 which provided the greatest absolute value amongst all the values of pressure differentials $\Delta P_i$ Once that metering pump has been identified, the controller 64 enters the logic regime B so as to resolve the appropriate magnitude of adjustment in accordance with a flow adjustment subroutine 350.

Preferably, the flow adjustment subroutine 350 includes a test ("Test No. 3") in a step 360 wherein it compares the pressure differential $\Delta P_i$ of the identified metering pump to a threshold value (such as 3 inches of water). If the measured pressure differential $\Delta P_i$ is greater than the threshold value, the logic circuit generates a control signal to the selected metering pump 150 to adjust its pump flow rate by a greater factor, which in the preferred embodiment is predetermined to be 10 percent of its then existing flow rate. In addition, if the measured pressure differential is negative (the local pressure is below the average pressure, then the pump flow of the selected metering pump 150 is increased by 10 percent. If the measured pressure differential is positive then the pump flow is reduced by 10 percent.

If the Test No. 3 at step 360 indicates that the absolute value of measured pressure differential is less than the threshold value (3 inches of water), then the logic circuit executes a signal generating step that commands an adjustment of flow rate in the identified pump by a lesser factor, which in the preferred embodiment is a five percent adjustment in flow rate (or speed). Upon executing either step 370 or 380 as a result of Test No. 3 and step 360, the logic circuit then executes the third logic subroutine C.

The logic regime C is arranged to maintain the grand total flow rate into the chamber box 30. It initiates with an analytical resolution of the change in total flow rate ("Δ Flow Rate") resulting from the adjustment in the pump flow of the selected metering pump 150 from the execution of the logic regime B. It then executes a step 400 in communication with all the remaining, non-selected metering pumps 150 to adjust each of the remaining (non-selected) metering pumps 150, preferably equally, in compensation of the Δ Flow Rate contributed by the selected metering pump so as to maintain the predetermined, grand total flow rate that had been established in step 210.

For example, if the first metering pump 150a is selected in logic regime B to have its flow rate increased by 10 percent in step 370 thereof, then in step 400 of logic regime C, all other metering pumps (150*b* through 150*z*) would have their flow rates decreased equally by the change in flow rate at pump 150*a* divided by the number of pumps in the set defined by pumps 150*b* through 150*z*.

Upon completion of the logic regime C, the logic circuit returns to the timing step 275, and after the 10 second delay, to the pressure reading step 230.

Figure 13:
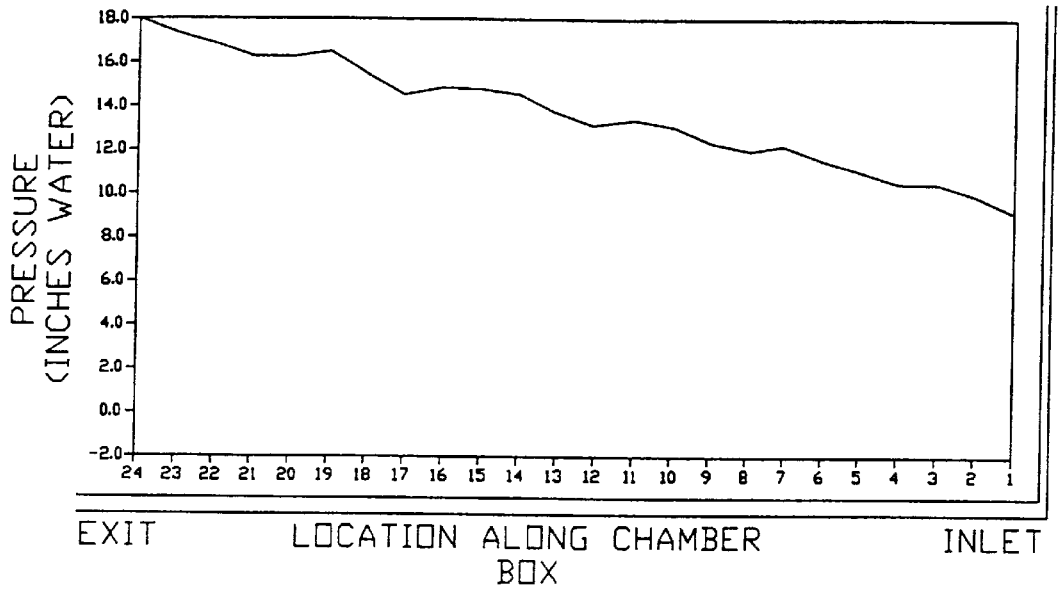
FIG. 13 is a graphical representation showing a set of pressure readings along stations 1–24 of the chamber box shown in FIG. 9 at startup of the moving orifice applicator and before the control sytem of the applicator has had an opportunity to minimize pressure variation.
Figure 14:
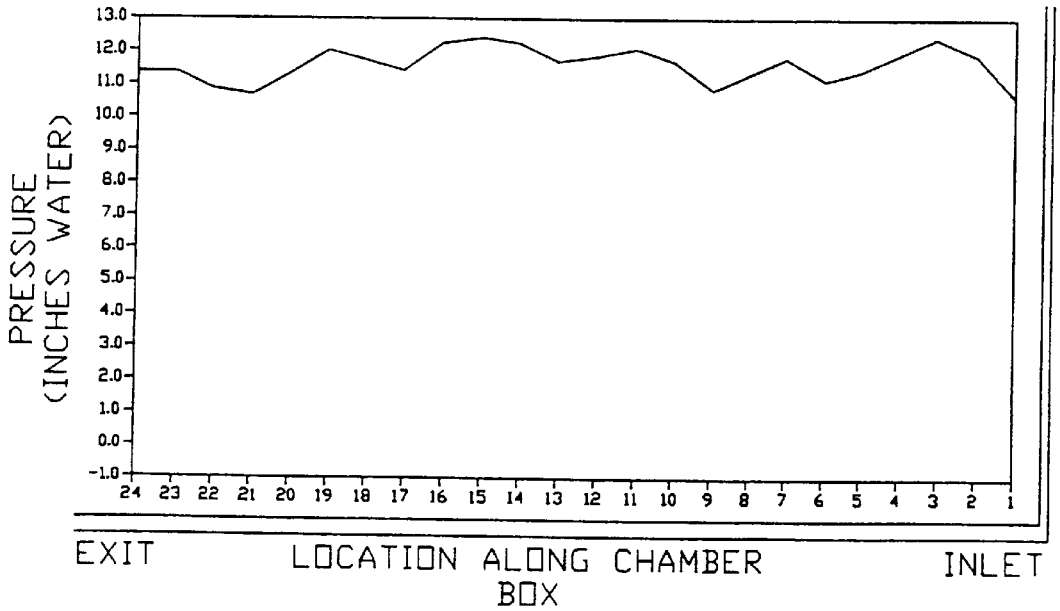
FIG. 14 is a graphical representation showing another set of pressure readings at stations 1–24 along the changer box shown in FIG. 9 after the control system of the applicator has undertaken adjustment of flow rates into the chamber box to minimize pressure variation.

Referring now to FIGS. 13 and 14, an applicator 10 having 24 pressure ports was started with a total slurry flow rate target of 6 gallons per minute, with all of the metering pumps 150 set at essentially equal speds, and with the controller 64 being inoperative. As shown in FIG. 13, under such conditions, the pressure along the chamber box was lowest at the inlet end (where the belt enters the chamber) and continued to generally increase along the chamber box 30 to the opposite end of the chamber box 30, creating a spread of pressure variation of approximately 8.3 inches of water.

Contrastingly, upon activation of the controller 64 and further operation of the slurry applicator, the pressure readings along the chamber box progressed toward those shown in FIG. 14, wherein the spread of pressure variation is reduced to 1.6 inches water. Having discovered that flow-rate at the orifices is very sensitive to discontinuities in chamber box pressure, the improved pressure uniformity achieved with the present invention contributes a more uniform discharge through each belt orifice as it moves along the bottom portion of the chamber box 30.

Figure 15:
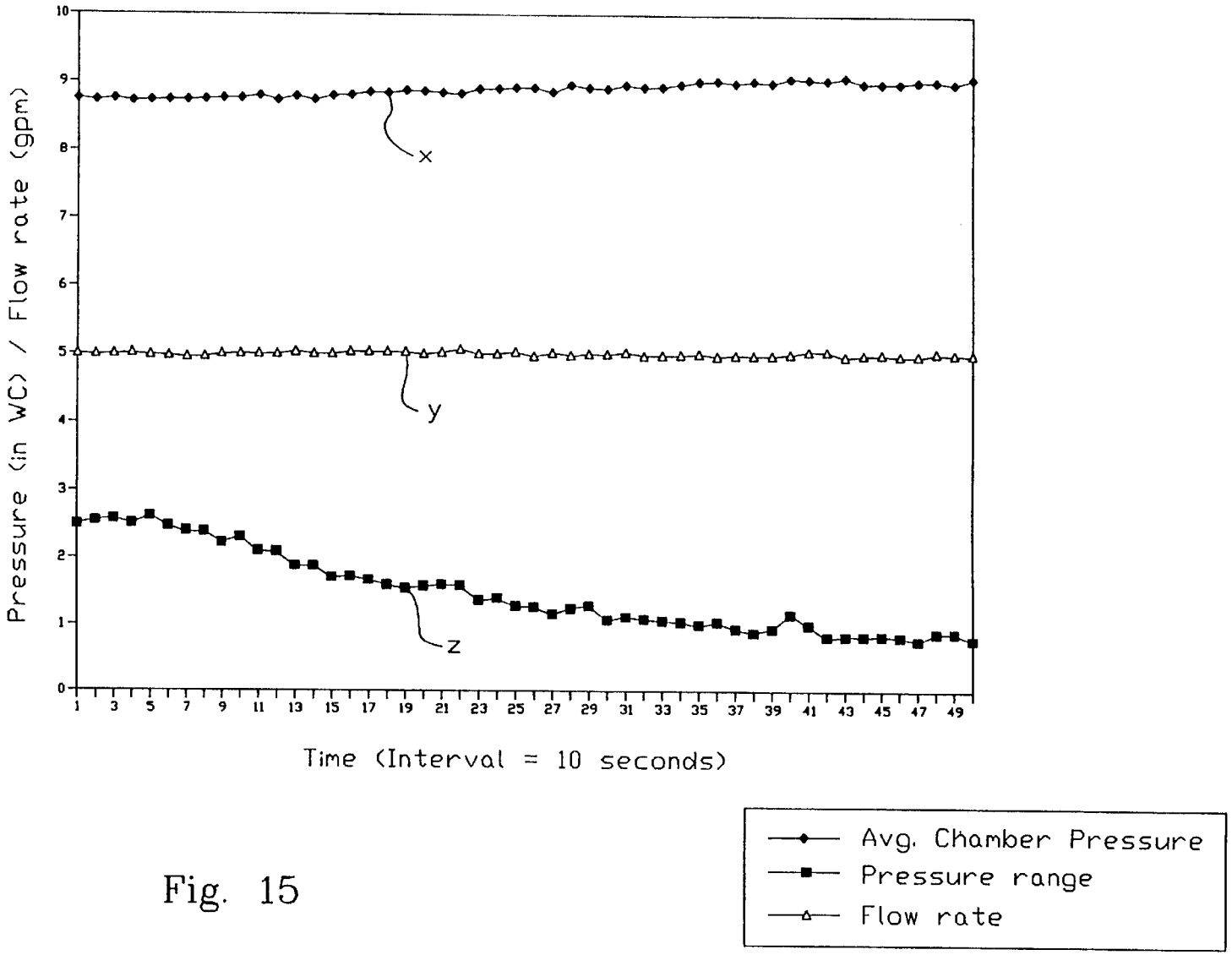
FIG. 15 is a graphical representation of fluid conditions (average chamber pressure, pressure variation and flow rate) in relation to progression of time of operation of the applicator.

Referring now to FIG. 15, a graphical representation is provided typifying fluid conditions in relation to a progression of time in an operation of the applicator 10 in accordance with the teachings of the present invention, wherein a line x indicates average pressure in the chamber box 30, line y indicates flow rate through the the chamber box 30 and line z indicates the magnitude of pressure variation along the chamber box 30. Line z evidences how in this example pressure variation is reduced to approximately one-third of initial values in a short period of time.

In operation, the desired uniform pressure level within the chamber box 30 as configured in the preferred embodiment is preferably between 6 to 18 inches of water. In some applications, it may be necessary to operate at higher pressures.

Many modifications, substitutions and improvements may be apparent to the skilled artisan without departing from the spirit and scope of the present invention as described and defined herein and in the following claims. By non-limiting examples, other expedients for maintaining uniform pressure in the chamber box and consequently, uniform jetting of slurry would become apparent to one of ordinary skill in the art upon reading this disclosure. Such alternatives might include establishing the desired, differentiated flow rates of the metering pumps empirically or through alternative feedback and looped control routines. In the preparation of the add-on slurry, different consistencies and feedstocks might be used, or different types or refiners and heat exhangers. Likewise, the base sheet slurry need not be nessarily laid upon a Fourdinier wire, but instead, could be placed upon an endless steel belt or any other arrangement known in the pertinent art as suitable for establishing a base web. Additionally, the base plate 78' might be rendered retractable in a like manner as were the shims 79' and 80' in the embodiment shown in FIG.6.

What it claimed is:

1. A method of manufacturing a web having an applied pattern of add-on material, said method comprising the steps of:

moving a base web along a first path;

preparing a slurry of add-on material;

repetitively discharging said add-on slurry upon said moving sheet of base web by:

establishing a reservoir of said add-on slurry across said first path; and continuously moving a belt having an orifice along an endless path said belt moving step including the step of moving said belt along a first portion of said endless path where said orifice is communicated with said reservoir so as to discharge said add-on slurry from said reservoir through said orifice onto said base web as said orifice traverses said first path portion; and said slurry discharging step including the step of controlling variation of fluid pressure along said reservoir so as to achieve consistent discharge of said add-on slurry from said orifice as said orifice traverses said first path portion, said step of controlling variation of fluid pressure comprising the steps of:

continuously supplying under pressure said add-on slurry into said reservoir at a plurality of ports along said reservoir;

monitoring fluid pressure at spaced locations along said reservoir;

resolving which monitored location contributes a variation of fluid pressure from a norm;

at a port adjacent said resolved location of highest pressure variation, adjusting the supply of said add-on slurry counteractively to said fluid pressure of the variation from the norm; and at a remainder of said ports, adjusting the supply of said add-on slurry in compensation to said supply adjusting step at said adjacent port so as to maintain said continuous supply of add-on slurry into said chamber box.

2. A method of manufacturing a web having an applied pattern of add-on material, said method comprising the steps of:

moving a base web along a first path;

preparing a slurry of add-on material;

repetitively discharging said add-on slurry upon said moving sheet of base web by:

establishing a reservoir of said add-on slurry across said first path: and continuously moving a belt having an orifice along an endless path, said belt moving step including the step of moving said belt along a first portion of said endless path where said orifice is communicated with said reservoir so as to discharge said add-on slurry from said reservoir through said orifice onto said base web as said orifice traverses said first path portion; and said slurry discharging step including the step of controlling variation of fluid pressure along said reservoir so as to achieve consistent discharge of said add-on slurry from said orifice as said orifice traverses said first path portion;

wherein said step of controlling pressure along said reservoir includes the steps of:

flowing said add-on slurry into said reservoir at spaced locations along said reservoir;

monitoring fluid pressure at a plurality of regions along said reservoir so as to identify amongst said monitored regions a region of greatest variation of pressure; and adjacent said region of greatest variation of pressure, adjusting the flow of said add-on slurry into said reservoir counteractively to said greatest variation of pressure.

3. The method as claimed in claim 2, wherein said belt moving step including the step of cleaning said add-on slurry from said belt after said step of communicating said belt with said reservoir.

4. The method as claimed in claim 2, wherein said step of supplying said add-on slurry includes introducing said slurry into said chamber box at locations vertically distal from said lower box portion.

5. The method as claimed in claim 2, wherein said step of preparing a slurry of add-on material includes the steps of:

preparing a cellulosic pulp;

repetitively refining said cellulosic pulp until a Freeness value is achieved in the range of approximately −300 to −900 ml °SR; and removing heat from said cellulosic pulp during at least a portion of said repetitively refining step.

6. The method as claimed in claim 5, further comprising the steps of preparing a base web slurry from a portion of said cellulosic pulp and forming said base web along said first path with said base web slurry and a paper-making apparatus.

7. The method as claimed in claim 6, wherein said establishing step locates the reservoir downstream of a wet-line of said paper-making apparatus.

8. The method as claimed in claim 6, wherein said step of preparing an add-on slurry includes the step of creating a weight percent solids content in the range of approximately 2 to 3 percent in said add-on slurry.

9. The method as claimed in claim 8, wherein said step of preparing an add-on slurry includes the step of adding chalk in the range of approximately up to 20 weight percent of said solids content.

10. The method as claimed in claim 8, wherein said base web forming step includes the step of creating a weight percent solids content in said base web slurry of less than approximately 1.0 percent.

11. The method as claimed in claim 10, wherein said step of preparing said base web slurry includes the step of adding chalk in the range of up to approximately 50 weight percent of said solids content.

12. The method as claimed in claim 2, wherein said step of preparing an add-on slurry includes the step of creating a weight percent solids content in the range of approximately 2 to 3 percent in said add-on slurry.

13. A method of manufacturing a web having an applied pattern of add-on material, said method comprising the steps of:

moving a base web along a first path;

preparing a slurry of add-on material;

repetitively discharging said add-on slurry upon said moving sheet of base web by:

establishing a reservoir of said add-on slurry across said first path; and continuously moving a belt having an orifice along an endless path, said belt moving step including the step of moving said belt along a first portion of said endless path where said orifice is communicated with said reservoir so as to discharge said add-on slurry from said reservoir through said orifice onto said base web as said orifice traverses said first path portion; and said slurry discharging step including the step of controlling variation of fluid pressure along said reservoir so as to achieve consistent discharge of said add-on slurry from said orifice as said orifice traverses said first path portion;

wherein said reservoir establishing step includes the step of locating an elongate chamber box across said first path and introducing said add-on slurry into said chamber box through ports at spaced locations along said box, said step of moving said belt along said first endless path portion including the step of moving said belt through a lower portion of said chamber box, said reservoir establishing step including the step of filling said chamber box with add-on slurry under pressure and continuously supplying said add-on slurry to said filled box under pressure through said ports from individually adjustable metering pumps, said step of controlling pressure comprising the steps of:

monitoring fluid pressure at spaced locations along said reservoir;

resolving which monitored location contributes a fluid pressure of a highest variation from a norm;

identifying a metering pump whose respective port is operatively adjacent said resolved location of highest pressure variation;

adjusting output of said identified metering pump counteractively to said fluid pressure of the highest variation from the norm; and adjusting output of a remainder of said metering pumps in compensation to said output adjusting step of said identified metering pump so as to maintain said continuous supply of add-on slurry into said chamber box.

14. A method of manufacturing a web having an applied pattern of add-on material, said method comprising the steps of:

moving a base web along a first path:

preparing a slurry of add-on material;

repetitively discharging said add-on slurry upon said moving sheet of base web by:

establishing a reservoir of said add-on slurry across said first path; and continuously moving a belt having an orifice along an endless path, said belt moving step including the step of moving said belt along a first portion of said endless path where said orifice is communicated with said reservoir so as to discharge said add-on slurry from said reservoir through said orifice onto said base web as said orifice traverses said first path portion; and said slurry discharging step including the step of controlling variation of fluid pressure along said reservoir so as to achieve consistent discharge of said add-on slurry from said orifice as said orifice traverses said first path portion;

wherein said step of controlling pressure along said reservoir includes the steps of supplying said add-on slurry to said reservoir by introduction of said add-on slurry into said reservoir at a plurality of spaced-apart, feed ports disposed along said reservoir and controlling said slurry introduction at each feed port by:

(a) reading fluid pressure at spaced locations along said reservoir;

(b) resolving whether variance among the pressure readings exceeds a predetermined value, and if said predetermined value is exceeded:

(c) resolving which pressure reading singularly contributes the greatest variance from a norm;

(d) identifying a feed port proximate to said pressure reading of greatest variance from the norm; and (e) adjusting the introduction of slurry at said identified feed port counteractively to said greatest variation.

15. The method as claimed in claim 14, further comprising the steps of establishing a predetermined total rate of slurry introduction into said reservoir, and upon execution of said adjusting step (e):

(f) adjusting the introduction of slurry at non-selected feed ports comprising those of said feed ports other than said identified feed port of step (e), said adjusting step (f) at said non-selected feed ports being in compensation to the adjustment of step (e) at said identified feed port so as to maintain said predetermined total rate of fluid introduction into said reservoir.

16. The method as claimed in claim 15, wherein reading step (a), said resolving step (b) and said resolving step (c) are undertaken repetitively, said adjusting step (e) and said adjusting step (f) being undertaken only if results of said resolving step (c) are consistent for a predetermined amount of time.

17. The method as claimed in claim 16, wherein said adjusting step (f) adjusts all of said non-selected locations equally.

18. The method as claimed in claim 17, wherein said norm is an average of said pressure readings.

19. The method as claimed in claim 16, wherein said step of adjusting the introduction of slurry at said identified feed port includes the steps of:

(i) resolving a magnitude of said greatest pressure variance from the norm;

(ii) comparing said resolved magnitude to a predetermined threshold value;

(iii) if said comparing step (ii) indicates that said absolute value is less than said threshold value; then said step of adjusting the introduction of slurry at said identified feed port is undertaken by a predetermined lesser factor; and (iii) if said comparing step (ii) indicates that said absolute value is greater than said threshold value; said step of adjusting the introduction of slurry at said identified feed port is undertaken by a predetermined greater factor.

20. A slurry applicator comprising a chamber box, an arrangement for supplying slurry to said chamber box and an endless belt arranged to pass through a lower portion of said chamber box, said endless belt having a hole, said endless belt received through said chamber box such that slurry supplied to said chamber box is discharged from said orifice as said orifice traverses through said chamber box;

said chamber box including sloped elements along an interior of said bottom portion, said sloped elements arranged to direct slurry toward a central portion of said endless belt;

said chamber box including a plurality of feed ports at spaced locations along an upper portion of said chamber box;

wherein said chamber box includes at said lower portion a slotted base plate, at least first and second wear strips disposed along opposite sides of said base plate and a guide channel at least partially defined between said wear strips and said base plate, said guide channel slidingly receiving said endless belt, said chamber box further including means for controllably retracting at least one of said first and second wear strips from said base plate.

21. An apparatus arranged to manufacture a web having an applied pattern of add-on material, said apparatus comprising:

a first arrangement which establishes a sheet of base web from a first slurry and moves said established sheet along a first path;

a second arrangement for preparing a add-on slurry;

a moving orifice applicator at a location along said first arrangement, said moving orifice applicator in communication with said second arrangement, said moving orifice operative so as to repetitively discharge said add-on slurry upon said moving sheet of base web, said moving orifice applicator comprising:

a chamber box arranged to establish a reservoir of said add-on slurry across said first path;

an endless belt having an orifice, said endless belt received through said chamber box such that said orifice is communicated with said reservoir;

a drive arrangement operative upon said endless belt to continuously move said orifice along an endless path and repetitively through said chamber box, said orifice when communicated with said reservoir being operative to discharge said second slurry from said reservoir through said orifice;

a flow distribution system for introducing said second slurry into said chamber box at spaced-apart feed locations along said chamber box;

a flow monitoring system for reading fluid pressure at spaced-apart locations along said chamber box; and a controller in communication with the output of said flow monitoring system, said controller arranged to identify which of said feed ports is operatively adjacent a monitored location of highest pressure variation, said controller selectively adjusting output of said flow distribution system at said identified feed location counteractively to said highest pressure variation, said controller adjusting output of a remainder of said feed locations counteractively to said output adjustment at said identified feed location;

whereby fluid pressure along said reservoir is controlled so as to achieve consistent discharge of said second slurry from said orifice as said orifice traverses through said chamber box.

22. The apparatus as claimed in claim 21, wherein said chamber box includes a slotted base plate at said lower portion, said endless belt passing beneath said base plate, said base plate reducing contact between fluid within said chamber box and edge portions along said endless belt so as to limit pumping action of the endless belt.

23. The apparatus as claimed in claim 22, wherein said base plate limits communication of fluid within said chamber box to a region along said endless belt immediate about said orifice.

24. The apparatus as claimed in claim 23, wherein said chamber box includes wear strips adjacent said base plate, said wear strips and said base plate defining a channel which slidingly receives said endless belt through said bottom portion of said chamber box.

25. The apparatus as claimed in claim 24, wherein said wear strips are movable from a first operative position to second retracted position.

26. The apparatus as claimed in claim 24, wherein said chamber box includes opposing vertical walls and bevelled elements located along corners defined between said vertical wall and said base plate, said bevelled elements arranged to urge fluid toward a central portion of said base plate.

27. The apparatus as claimed in claim 21, wherein said feed locations of said applicator comprise a plurality of feed ports at spaced locations along an upper portion of said chamber box, said feed ports vertically spaced away from said lower portion so that fluid velocity within said chamber at said lower portion is attenuated.

28. The apparatus as claimed in claim 27, wherein said feed ports discharge fluid horizontally.

29. The apparatus as claimed in claim 28, wherein said chamber box includes opposing vertical walls, a centrally slotted base plate and bevelled elements located along corners defined between said vertical walls and said base plate, said bevelled elements arranged to urge fluid toward said centrally slotted portion of said base plate.

30. The applicator as claimed in claim 27 further comprising a second plurality of ports at spaced locations along said chamber box, said pressure monitoring system including a plurality of pressure sensors in operative communication with said second plurality of ports, said controller in communication with said plurality of pressure sensors to adjust fluid conditions at a selected sub-set of said feed ports responsively to input received from said plurality of pressure sensors.

31. The apparatus as claimed in claim 30, wherein said flow distribution system comprises a plurality of metering pumps, each metering pump being in fluid communication with at least one of said feed ports, said controller identifying which of said feed pumps is operatively adjacent a monitored location of highest pressure variation, said controller selectively adjusting output of the selected metering pump counteractively to said highest pressure variation, said controller adjusting output of a remainder of said metering pumps counteractively to said output adjustment at said identified metering pump so that uniform fluid pressure along said chamber box and total flow into said chamber box are maintained.

32. The apparatus as claimed in claim 31, wherein said controller adjusts the output of said remainder of feed pumps proportionally equally responsively to maintain a total flow rate of said second slurry.

33. The apparatus as claimed in claim 30, wherein said pressure sensors each comprise a first conduit leading to at least one of said second ports, a pressure transducer at a first location along said first conduit and an arrangement operable to establish a water column along said first conduit.

34. The apparatus as claimed in claim 33, wherein said arrangement operable to establish a water column along said first conduit comprises a source of water, a control valve, and means for selectively opening and closing said control valve, said source of water communicated with said first conduit through said control valve, said control valve closable to establish said water column, said control valve openable to flush said pressure sensor and said chamber box with water from said source of water.

35. The apparatus as claimed in claim 21, wherein said first arrangement comprises a fourdinier wire, said moving orifice applicator being located downstream of a dry line region of said Fourdrinier wire.

36. The apparatus as claimed in claim 35, wherein said applicator cooperates with a vacuum box located coextensively beneath said chamber box of said moving orifice applicator.

37. The apparatus as claimed in claim 21, wherein said second arrangement comprises a refiner, a heat exchanger and a circulation system for circulating said second slurry repetitively through said disc refiner and heat exchanger until said second slurry achieves a predetermined level of Freeness.

38. The apparatus as claimed in claim 37, wherein said second arrangement is operable to achieve in said second slurry a predetermined level of Freeness in the range of −300 to −900 ml °SR.

39. The apparatus as claimed in claim 21, wherein said orifice in said endless belt is bevelled on a side facing into said chamber box.

40. The apparatus as claimed in claim 21, wherein said moving orifice applicator further comprises a cleaning arrangement operative upon said endless belt so as to remove extraneous fluid from said endless belt after said endless belt exits said chamber box, said cleaning arrangement comprising a wiper element slidingly receiving said endless belt and means for discharging fluid transversely across said endless belt.

41. The apparatus as claimed in claim 40, wherein said cleaning arrangement comprising a wiper element slidingly receiving said endless belt and means for discharging fluid transversely across said endless belt.

42. The apparatus as claimed in claim 40, wherein said cleaning arrangement comprising a plurality wiper elements, each wiper element comprising a pair of opposing fibrous elements slidingly receiving said endless belt therebetween and means for discharging fluid transversely across said endless belt and along passageways defined between said adjacent pairs of wiper elements.

43. The apparatus as claimed in claim 42, wherein said discharging means includes a first plurality of nozzles arranged to discharge water through a first set of said passageways and a second set of nozzles arranged to discharge a gas through a subsequent set of said passageways.

44. The apparatus as claimed in claim 21, wherein drive arrangement of said moving orifice applicator comprises a drive wheel operative upon said endless belt and located beyond an exit of said chamber box for said endless belt, a guide wheel arrangement operative upon said endless belt to maintain a tracking of said endless belt along a predetermined path and a follower wheel operative to direct said endless belt toward an entrance to said chamber box, said drive arrangement further comprising a selectable speed motor and a drive connection between said motor and said drive wheel, said motor, said drive connection, said guide wheel and said follower wheel being at least partially enclosed within a housing.

45. The apparatus as claimed in claim 44, wherein said guide wheel arrangement includes a detector operative to detect transverse movement of said along said predetermined path and means for adjusting a yaw orientation of a guide wheel responsively to the output of said detector so as to return said endless belt to said tracking.

46. The apparatus as claimed in claim 45, wherein detector comprises an infrared beam detector operable upon an edge portion of said endless belt.

47. A slurry applicator comprising a chamber box, an arrangement for supplying slurry to said chamber box and an endless belt arranged to pass through a lower portion of said chamber box, said endless belt having a hole, said endless belt received through said chamber box such that slurry supplied to said chamber box is discharged from said orifice as said orifice traverses through said chamber box;

wherein said chamber box includes at said lower portion a slotted base plate, at least first and second wear strips disposed along opposite sides of said base plate and a guide channel at least partially defined between said wear strips and said base plate, said guide channel slidingly receiving said endless belt:

said slurry applicator further comprising means for controllably retracting at least one of said first and second wear strips away from said base plate.

48. The slurry applicator as claimed in claim 47, wherein said hole is beveled on a side of said belt facing into said chamber box.

* * * * *